US010927440B2

(12) United States Patent
Na et al.

(10) Patent No.: US 10,927,440 B2
(45) Date of Patent: Feb. 23, 2021

(54) ZIRCONIUM-TITANIUM-COPPER-NICKEL-ALUMINUM GLASSES WITH HIGH GLASS FORMING ABILITY AND HIGH THERMAL STABILITY

(71) Applicant: Glassimetal Technology, Inc., Pasadena, CA (US)

(72) Inventors: Jong Hyun Na, Pasadena, CA (US); Glenn Garrett, Pasadena, CA (US); Kyung-Hee Han, Pasadena, CA (US); Georg Kaltenboeck, Pasadena, CA (US); Chase Crewdson, Los Angeles, CA (US); Marios D. Demetriou, West Hollywood, CA (US); William L. Johnson, San Marino, CA (US)

(73) Assignee: Glassimetal Technology, Inc., Pasadena, CA (US)

( * ) Notice: Subject to any disclaimer, the term of this patent is extended or adjusted under 35 U.S.C. 154(b) by 612 days.

(21) Appl. No.: 15/442,535

(22) Filed: Feb. 24, 2017

(65) Prior Publication Data

US 2017/0241006 A1 Aug. 24, 2017

Related U.S. Application Data

(60) Provisional application No. 62/299,365, filed on Feb. 24, 2016.

(51) Int. Cl.

| | |
|---|---|
| ***C22F 1/18*** | (2006.01) |
| ***C22F 1/00*** | (2006.01) |
| ***C22C 45/10*** | (2006.01) |

(52) U.S. Cl.
CPC ..... *C22F 1/186* (2013.01); *C22C 45/10* (2013.01); *C22F 1/002* (2013.01)

(58) Field of Classification Search
CPC ..... C22F 1/186; C22F 1/002; C22C 45/10
See application file for complete search history.

(56) References Cited

U.S. PATENT DOCUMENTS

| | | | | |
|---|---|---|---|---|
| 5,032,196 | A | 7/1991 | Masumoto et al. | |
| 5,735,975 | A * | 4/1998 | Lin | C22C 45/10 148/403 |
| 6,521,058 | B1 | 2/2003 | Inoue et al. | |
| 6,652,673 | B1 * | 11/2003 | Inoue | C22C 45/10 148/403 |
| 8,613,813 | B2 | 12/2013 | Johnson et al. | |
| 8,613,814 | B2 | 12/2013 | Kaltenboeck et al. | |
| 8,613,815 | B2 | 12/2013 | Johnson et al. | |
| 8,613,816 | B2 | 12/2013 | Kaltenboeck et al. | |
| 9,297,058 | B2 | 3/2016 | Demetriou et al. | |
| 2009/0202386 | A1 | 8/2009 | Yi et al. | |

(Continued)

OTHER PUBLICATIONS

Xing et al., "Crystallization Behaviors of ZrCuNiAlTi4 Bulk Amorphous Alloy during Continuous Heating," Rare Metals Materials and Engineering 36(7), pp. 1181-1184 (2007).

(Continued)

*Primary Examiner* — John A Hevey
(74) *Attorney, Agent, or Firm* — KPPB LLP

(57) ABSTRACT

The disclosure provides Zr—Ti—Cu—Ni—Al metallic glass-forming alloys and metallic glasses that have a high glass forming ability along with a high thermal stability of the supercooled liquid against crystallization.

23 Claims, 14 Drawing Sheets

(56) References Cited

U.S. PATENT DOCUMENTS

2016/0289813 A1* 10/2016 Shin ..... B82Y 30/00

OTHER PUBLICATIONS

U. Kuhn, "Strukturelle und Mechanische Charakterisierung von Vielkomponentigen Amorphen, Teilamorphen und Kristallinen Zirkon-Basislegierungen," Doctoral Dissertation, Technischen Universität Dresden, (2004), 180 pages, with machine translation of Summary (pp. 158-160).
U.S. Appl. No. 15/406,436, filed Jan. 13, 2017, Schramm et al.

* cited by examiner

ZIRCONIUM-TITANIUM-COPPER-NICKEL-ALUMINUM GLASSES WITH HIGH GLASS FORMING ABILITY AND HIGH THERMAL STABILITY

CROSS-REFERENCE TO RELATED PATENT APPLICATION

This patent application claims the benefit of U.S. Patent Application No. 62/299,365, entitled "ZIRCONIUM-TITANIUM-COPPER-NICKEL-ALUMINUM GLASSES WITH HIGH GLASS FORMING ABILITY AND HIGH THERMAL STABILITY," filed on Feb. 24, 2016 under 35 U.S.C. § 119(e), which is incorporated herein by reference in its entirety.

FIELD

The disclosure is directed to Zr—Ti—Cu—Ni—Al metallic glasses having a high glass forming ability and a high thermal stability of the supercooled liquid against crystallization.

BACKGROUND

U.S. Pat. No. 5,032,196, entitled "Amorphous Alloys Having Superior Processability," the disclosure of which is incorporated herein by reference in its entirety, discloses ternary Zr—Cu—Al and quaternary Zr—Cu—Ni—Al alloys capable of forming glasses in geometries with thin lateral dimensions (i.e. where the thickness is on the order of micrometers), where the Zr atomic concentration varies in the range of 25 to 85 percent, the combined Ni and Cu atomic concentration varies in the range of 5 to 70 percent, and the Al atomic concentration varies in the range of up to 35 percent. The patent also discloses that the Zr—Cu—Al and Zr—Cu—Ni—Al alloys may optionally contain Ti in an atomic concentration of up to 5 percent without altering the disclosed effects of the alloys. The patent presents several examples of micrometer-thick amorphous Zr—Cu—Al ribbons where the thermal stability of the supercooled liquid (i.e. the difference between the crystallization and glass transition temperatures) at an unspecified heating rate ranges from 0° C. to 91° C. between the various compositions.

U.S. Pat. No. 5,735,975, entitled "Quinary Metallic Glass Alloys," the disclosure of which is incorporated herein by reference in its entirety, discloses quinary Zr—Ti—Cu—Ni—Al alloys capable of forming glasses in bulk geometries (i.e. where the thicknesses is on the order of millimeters), where the Zr atomic concentration varies in the range of 45 to 65 percent, the Ti atomic concentration varies in the range of 5 to 7.5 percent, the Al atomic concentration varies in the range of 5 to 15 percent, and the balance is a combination of Ni and Cu, where the ratio of Cu to Ni concentration is in the range of 0.5 to 2.

U.S. Pat. No. 6,521,058, entitled "High-Strength High-Toughness Amorphous Zirconium Alloy," the disclosure of which is incorporated herein by reference in its entirety, discloses quinary Zr—Ti—Cu—Ni—Al alloys capable of forming in bulk geometries (i.e. where the thicknesses is on the order of millimeters), where the Ti atomic concentration is up to 7 percent, the combined atomic concentration of Ni and Cu varies in the range of 30 to 50 percent, where the ratio of Cu to Ni concentration is at least 3, the Al atomic concentration varies in the range of 5 to 10 percent, and the balance is Zr.

U.S. Patent Publication No. 2009/0202386, entitled "Alloys, Bulk Metallic Glass, and Methods of Forming the Same," the disclosure of which is incorporated herein by reference in its entirety, discloses quinary Zr—Ti—Cu—Ni—Al capable of forming glasses in bulk geometries (i.e. where the thicknesses is on the order of millimeters), where the combined atomic concentration of Ni and Cu varies in the range of 37 to 48 percent, where the ratio of Cu to Ni concentration is in the range of 7/3 to 97/3, the Al atomic concentration varies in the range of 3 to 14 percent, and the balance is a combination of Zr and Ti.

Xin et al. (D. W. Xin, Y. Huang, J. Shen, "Crystallization Behaviors of ZrCuNiAlTi4 Bulk Amorphous Alloy during Continuous Heating," Rare Metals Materials and Engineering 36(7), 1181-1184 (2007)), the disclosure of which is incorporated herein by reference in its entirety, discloses one Zr—Ti—Cu—Ni—Al metallic glass-forming alloy with composition $Zr_{56.6}Cu_{17.3}Ni_{12.5}Al_{9.6}Ti_4$ capable of forming bulk amorphous rods with diameters of up to 3 mm. The disclosure also reports that the thermal stability of the supercooled liquid (i.e. the difference between the crystallization and glass transition temperatures) at a heating rate of 20 K/min is 75.4° C.

Kun (U. Kun, "Strukturelle und Mechanische Charakterisierung von Vielkomponentigen Amorphen, Teilamorphen und Kristallinen Zirkon-Basislegierungen," Doctoral Dissertation, Technischen Universitat Dresden, (2004)), the disclosure of which is incorporated herein by reference in its entirety, discloses Zr—Ti—Cu—Ni—Al metallic glass-forming alloys with atomic fractions of Cu, Ni, and Al fixed at 20%, 8%, and 10% respectively, an atomic fraction of Zr in the rage of 55 to 62% and atomic fraction of Ti in the range of 0 to 7%. Rods with complete absence of crystallinity were obtained only when the rod diameter was 3 mm or less, while presence of crystals was always present in larger diameter rods. The disclosure also reported that the alloys exhibit a thermal stability of the supercooled liquid (i.e. the difference between the crystallization and glass transition temperatures) evaluated at a heating rate of 40 K/min that ranges from 54 to 118° C.

BRIEF DESCRIPTION OF THE DRAWINGS

The description will be more fully understood with reference to the following figures and data graphs, which are presented as various embodiments of the disclosure and should not be construed as a complete recitation of the scope of the disclosure, wherein.

BRIEF SUMMARY

Figure 1:
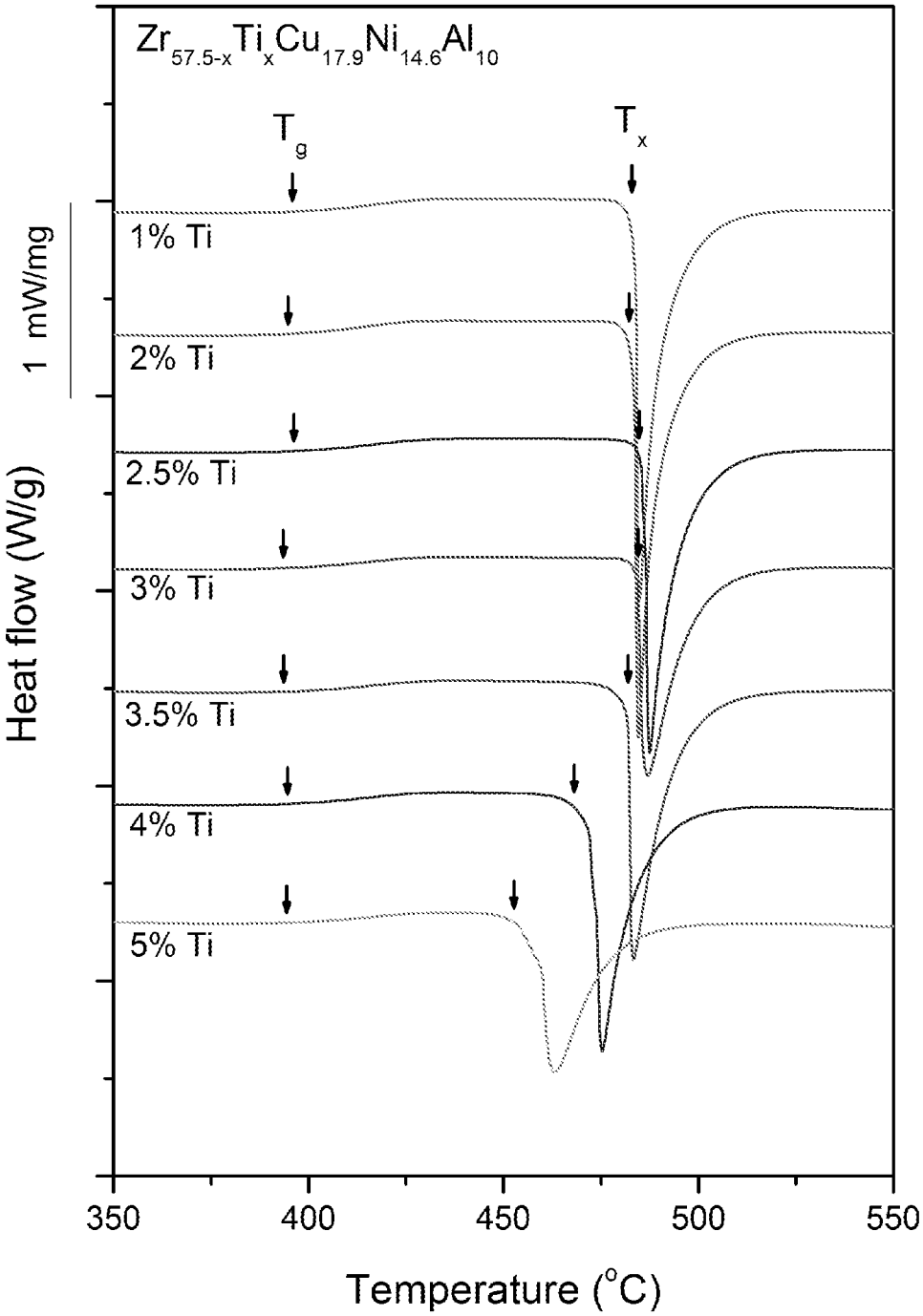
FIG. 1 provides calorimetry scans for sample metallic glasses according to $Zr_{57.5-x}Ti_xCu_{17.9}Ni_{14.6}Al_{10}$ in accordance with embodiments of the disclosure. The glass transition temperature $T_g$ and crystallization temperature $T_x$ are indicated by arrows.

The disclosure provides Zr—Ti—Cu—Ni—Al metallic glass-forming alloys and metallic glasses that have a high glass forming ability along with a high thermal stability of the supercooled liquid against crystallization.

In one embodiment, the disclosure provides a metallic glass-forming alloy or a metallic glass having a composition represented by the following formula (subscripts denote atomic percentages):

$$Zr_{(100-a-b-c-d)}Ti_aCu_bNi_cAl_d \quad \text{EQ. (1)}$$

where:

a ranges from 0.5 to less than 4;

b ranges from 12 to 20;

c ranges from 9 to 18; and d ranges from 7 to 13, wherein the metallic glass-forming alloy has a critical plate thickness of at least 4 mm, and wherein the thermal stability of the supercooled liquid of the metallic glass against crystallization is at least 78° C.

In one embodiment, the disclosure provides a metallic glass-forming alloy or a metallic glass having a composition represented by the following formula (subscripts denote atomic percentages):

$$Zr_{(100-a-b-c-d)}Ti_aCu_bNi_cAl_d \quad \text{EQ. (1)}$$

where:

a ranges from 0.5 to less than 4;

b ranges from 12 to 20;

c ranges from 9 to 18; and d ranges from 7 to 13, wherein the metallic glass-forming alloy has a critical plate thickness of at least 4 mm, and wherein the time for isothermal crystallization when the metallic glass is heated at a supercooling temperature of less than 250° C. is at least 0.5 s.

In one embodiment, the disclosure provides a metallic glass-forming alloy or a metallic glass having a composition represented by the following formula (subscripts denote atomic percentages):

$$Zr_{(100-a-b-c-d)}Ti_aCu_bNi_cAl_d \quad \text{EQ. (1)}$$

where:

a ranges from 0.5 to less than 4;

b ranges from 12 to 20;

c ranges from 9 to 18; and d ranges from 7 to 13, wherein the metallic glass-forming alloy and has a critical plate thickness of at least 4 mm, and wherein the time for isothermal crystallization when the metallic glass is heated at a normalized supercooling temperature of less than 0.4 is at least 0.5 s.

In another embodiment of the metallic glass-forming alloy or metallic glass, a ranges from 0.5 to 3.9.

In another embodiment of the metallic glass-forming alloy or metallic glass, a ranges from 1 to 3.8.

In another embodiment of the metallic glass-forming alloy or metallic glass, a ranges from 1.5 to 3.7.

In another embodiment of the metallic glass-forming alloy or metallic glass, a ranges from 2 to 3.6.

In another embodiment of the metallic glass-forming alloy or metallic glass, a ranges from 2.5 to 3.5.

In another embodiment of the metallic glass-forming alloy or metallic glass, b ranges from 13 to 19.

In another embodiment of the metallic glass-forming alloy or metallic glass, b ranges from 14 to 18.

In another embodiment of the metallic glass-forming alloy or metallic glass, b ranges from 14.5 to 17.5.

In another embodiment of the metallic glass-forming alloy or metallic glass, b ranges from 15 to 17.

In another embodiment of the metallic glass-forming alloy or metallic glass, c ranges from 10 to 17.5.

In another embodiment of the metallic glass-forming alloy or metallic glass, c ranges from 12 to 17.

In another embodiment of the metallic glass-forming alloy or metallic glass, c ranges from 13 to 16.5.

In another embodiment of the metallic glass-forming alloy or metallic glass, c ranges from 13.5 to 16.

In another embodiment of the metallic glass-forming alloy or metallic glass, d ranges from 8 to 12.

In another embodiment of the metallic glass-forming alloy or metallic glass, d ranges from 8.5 to 11.5.

In another embodiment of the metallic glass-forming alloy or metallic glass, d ranges from 8.75 to 11.25.

In another embodiment of the metallic glass-forming alloy or metallic glass, d ranges from 9 to 11.

In another embodiment of the metallic glass-forming alloy or metallic glass, d ranges from 9.25 to 10.75.

In another embodiment of the metallic glass-forming alloy or metallic glass, the ratio b/c ranges from 0.65 to 2.

In another embodiment of the metallic glass-forming alloy or metallic glass, the ratio b/c ranges from 0.75 to 1.75.

In another embodiment of the metallic glass-forming alloy or metallic glass, the ratio b/c ranges from 1 to 1.5.

In another embodiment, the critical plate thickness is at least 5 mm.

In another embodiment, the critical plate thickness is at least 6 mm.

In another embodiment, the critical plate thickness is at least 7 mm.

In another embodiment, the liquidus temperature of the alloy is below 850° C.

In another embodiment, the liquidus temperature of the alloy is below 845° C.

In another embodiment, the liquidus temperature of the alloy is below 840° C.

In another embodiment, the liquidus temperature of the alloy is below 835° C.

In another embodiment, the liquidus temperature of the alloy is below 830° C.

In another embodiment, the thermal stability of the supercooled liquid is at least 79° C.

In another embodiment, the thermal stability of the supercooled liquid is at least 80° C.

In another embodiment, the thermal stability of the supercooled liquid is at least 82° C.

In another embodiment, the thermal stability of the supercooled liquid is at least 85° C.

In another embodiment, the thermal stability of the supercooled liquid is at least 90° C.

In another embodiment, the time for isothermal crystallization when the metallic glass is heated at a supercooling temperature of less than 250° C. is at least 0.7 s.

In another embodiment, the time for isothermal crystallization when the metallic glass is heated at a supercooling temperature of less than 240° C. is at least 0.6 s.

In another embodiment, the time for isothermal crystallization when the metallic glass is heated at a supercooling temperature of less than 240° C. is at least 0.8 s.

In another embodiment, the time for isothermal crystallization when the metallic glass is heated at a supercooling temperature of less than 230° C. is at least 0.7 s.

In another embodiment, the time for isothermal crystallization when the metallic glass is heated at a supercooling temperature of less than 230° C. is at least 0.9 s.

In another embodiment, the time for isothermal crystallization when the metallic glass is heated at a supercooling temperature of less than 220° C. is at least 0.8 s.

In another embodiment, the time for isothermal crystallization when the metallic glass is heated at a supercooling temperature of less than 220° C. is at least 1 s.

In another embodiment, the time for isothermal crystallization when the metallic glass is heated at a normalized supercooling temperature of less than 0.4 is at least 0.7 s.

In another embodiment, the time for isothermal crystallization when the metallic glass is heated at a normalized supercooling temperature of less than 0.38 is at least 0.6 s.

In another embodiment, the time for isothermal crystallization when the metallic glass is heated at a normalized supercooling temperature of less than 0.38 is at least 0.8 s.

In another embodiment, the time for isothermal crystallization when the metallic glass is heated at a normalized supercooling temperature of less than 0.36 is at least 0.7 s.

In another embodiment, the time for isothermal crystallization when the metallic glass is heated at a normalized supercooling temperature of less than 0.36 is at least 0.9 s.

In another embodiment, the time for isothermal crystallization when the metallic glass is heated at a normalized supercooling temperature of less than 0.34 is at least 0.8 s.

In another embodiment, the time for isothermal crystallization when the metallic glass is heated at a normalized supercooling temperature of less than 0.34 is at least 1 s.

In another embodiment, a ranges from 0.5 to 3.9, b ranges from 13 to 19, c ranges from 10 to 17.5, and d ranges from 8 to 12, wherein the critical plate thickness is at least 4 mm, and wherein the thermal stability of the supercooled liquid is at least 80° C.

In another embodiment, a ranges from 1.5 to 3.7, b ranges from 14 to 18, c ranges from 12 to 17, and d ranges from 8.5 to 11.5, wherein the critical plate thickness is at least 5 mm, and wherein the thermal stability of the supercooled liquid is at least 85° C.

In another embodiment, a ranges from 2.5 to 3.5, b ranges from 15 to 17, c ranges from 13.5 to 16, and d ranges from 9 to 11, wherein the critical plate thickness is at least 6 mm, and wherein the thermal stability of the supercooled liquid is at least 90° C.

In another embodiment, the metallic glass-forming alloy or metallic glass may also comprise at least one of Nb, Ag, Pd, Co, Fe, Sn, and Be in a combined atomic concentration of up to 2%.

The disclosure is also directed to a method of forming a metallic glass, or an article made of a metallic glass, from the metallic glass-forming alloy.

The method includes heating and melting an ingot comprising the metallic glass-forming alloy under inert atmosphere to create a molten alloy, and subsequently quenching the molten alloy fast enough to avoid crystallization of the molten alloy.

In one embodiment, prior to quenching the molten alloy is heated to at least 100° C. above the liquidus temperature of the metallic glass-forming alloy.

In another embodiment, prior to quenching the molten alloy is heated to at least 200° C. above the liquidus temperature of the metallic glass-forming alloy.

In yet another embodiment, prior to quenching the molten alloy is heated to at least 1100° C.

In yet another embodiment, prior to quenching the molten alloy is heated to at least 1200° C.

The disclosure is also directed to a method of thermoplastically shaping a metallic glass into an article, including: heating a sample of the metallic glass to a softening temperature $T_o$ above the glass transition temperature $T_g$, of the metallic glass to create a heated sample; applying a deformational force to shape the heated sample over a time $t_o$ that is shorter than the time it takes for the metallic glass to crystallize at $T_o$, and cooling the heated sample to a temperature below $T_g$ to form an article.

In one embodiment, $T_o$ is higher than $T_g$ and lower the liquidus temperature of the metallic glass-forming alloy.

In another embodiment, $T_o$ is greater than $T_g$ and lower than $T_x$.

In another embodiment, $T_o$ is higher than $T_x$ and lower than the solidus temperature of the metallic glass-forming alloy.

In another embodiment, $T_o$ is in the range of 500 to 800° C.

In another embodiment, $T_o$ is in the range of 525 to 700° C.

In another embodiment, $T_o$ is in the range of 550 to 650° C.

In another embodiment, $T_o$ is such that the supercooling temperature is in the range of 190 to 260° C.

In another embodiment, $T_o$ is such that the supercooling temperature is in the range of 200 to 250° C.

In another embodiment, $T_o$ is such that the supercooling temperature is in the range of 210 to 240° C.

In another embodiment, $T_o$ is such that the normalized supercooling temperature is in the range of 0.3 to 0.4.

In another embodiment, $T_o$ is such that the normalized supercooling temperature is in the range of 0.31 to 0.39.

In another embodiment, $T_o$ is such that the normalized supercooling temperature is in the range of 0.32 to 0.38.

In another embodiment, the viscosity of the sample at $T_o$ is less than $10^5$ Pa-s.

In another embodiment, the viscosity of the sample at $T_o$ is in the range of $10^0$ to $10^5$ Pa-s.

In another embodiment, the viscosity of the sample at $T_o$ is in the range of $10^1$ to $10^4$ Pa-s.

In another embodiment, heating of the sample of the metallic glass-forming alloy is performed by conduction to a hot surface.

In another embodiment, heating of the sample of the metallic glass-forming alloy is performed by inductive heating.

In another embodiment, heating of the sample of the metallic glass-forming alloy is performed by ohmic heating.

In another embodiment, the ohmic heating is performed by the discharge of at least one capacitor.

The disclosure is also directed to a metallic glass-forming alloy or a metallic glass having compositions selected from a group consisting of: $Zr_{56.5}Ti_1Cu_{17.9}Ni_{14.6}Al_{10}$, $Zr_{55.5}Ti_2Cu_{17.9}Ni_{14.6}Al_{10}$, $Zr_{55}Ti_{2.5}Cu_{17.9}Ni_{14.6}Al_{10}$, $Zr_{54.5}Ti_3Cu_{17.9}Ni_{14.6}Al_{10}$, $Zr_{54}Ti_{3.5}Cu_{17.9}Ni_{14.6}Al_{10}$, $Zr_{55.5}Ti_3Cu_{17.9}Ni_{14.6}Al_9$, $Zr_{53.5}Ti_3Cu_{17.9}Ni_{14.6}Al_{11}$, $Zr_{56.5}Ti_3Cu_{17.9}Ni_{12.6}Al_{10}$, $Zr_{56.5}Ti_3Cu_{17.9}Ni_{16.6}Al_{10}$, $Zr_{58.5}Ti_3Cu_{13.9}Ni_{14.6}Al_{10}$, $Zr_{57.5}Ti_3Cu_{14.9}Ni_{14.6}Al_{10}$, $Zr_{56.5}Ti_3Cu_{15.9}Ni_{14.6}Al_{10}$, $Zr_{55.5}Ti_3Cu_{16.9}Ni_{14.6}Al_{10}$, and $Zr_{53.5}Ti_3Cu_{18.9}Ni_{14.6}Al_{10}$.

DETAILED DESCRIPTION

The disclosure may be understood by reference to the following detailed description, taken in conjunction with the drawings as described below. It is noted that, for purposes of illustrative clarity, certain elements in various drawings may not be drawn to scale.

In the disclosure, the glass-forming ability of each alloy is quantified by the "critical plate thickness," defined as the largest plate thickness in which the amorphous phase can be formed when processed by a method of casting the molten alloy in a copper mold having a prismatic cavity, where at least one dimension of the rectangular cavity is lower than 50% of at least one other dimension of the rectangular cavity.

A "critical cooling rate," which is defined as the cooling rate required to avoid crystallization and form the amorphous phase of the metallic glass-forming alloy (i.e. the metallic glass), determines the critical plate thickness. The lower the critical cooling rate of a metallic glass-forming alloy, the larger its critical plate thickness. The critical cooling rate $R_c$ in K/s and critical plate thickness $t_c$ in mm are related via the following approximate empirical formula:

$$R_c=1000/t_c^2 \quad \text{Eq. (2)}$$

According to Eq. (2), the critical cooling rate for a metallic glass-forming alloy having a critical casting thickness of about 1 mm is about $10^3$ K/s.

Generally, three categories are known in the art for identifying the ability of an alloy to form a metallic glass (i.e. to bypass the stable crystal phase and form an amorphous phase). Alloys having critical cooling rates in excess of $10^{12}$ K/s are typically referred to as non-glass formers, as it is physically impossible to achieve such cooling rates over a meaningful thickness. Alloys having critical cooling rates in the range of $10^5$ to $10^{12}$ K/s are typically referred to as marginal glass formers, as they are able to form metallic glass foils or ribbons with thicknesses ranging from 1 to 100 micrometers according to EQ. (2). Metal alloys having critical cooling rates on the order of $10^3$ or less, and as low as 1 or 0.1 K/s, are typically referred to as bulk glass formers, as they are able to form metallic glass plates with thicknesses ranging from 1 millimeter to several centimeters. The glass-forming ability of a metallic alloy is, to a very large extent, dependent on the composition of the metallic glass-forming alloy. The compositional ranges for alloys that are marginal glass formers are considerably broader than those which are bulk glass formers.

Often in the art, a measure of glass forming ability of an alloy is reported as the critical rod diameter instead of the critical plate thickness. Due to its symmetry, the diameter of a rod for which a certain cooling rate is achieved at its centerline is about twice the thickness of a plate for which the same cooling rate is achieved at its centerline. Hence, the critical rod diameter to achieve a critical cooling rate is about twice the critical plate thickness to achieve the same critical cooling rate. Therefore, a critical rod diameter can be approximately converted to a critical plate thickness by dividing by 2.

In the disclosure, the thermal stability of the supercooled liquid $\Delta T_x$ is defined as the difference between the crystallization temperature $T_x$ and the glass transition temperature $T_g$ of the metallic glass, $\Delta T_x=T_x-T_g$, measured by calorimetry at a heating rate of 20 K/min.

The thermal stability of the supercooled liquid $\Delta T_x$ is a property defining the ability of the metallic glass to be shaped "thermoplastically" in the supercooled liquid region, i.e. to be shaped by heating the metallic glass to a softening temperature $T_o$ above the glass transition temperature $T_g$, applying a deformational force to shape the metallic glass over a time $t_o$ that is shorter than the time it takes for the softened metallic glass to crystallize at $T_o$, and cooling the metallic glass to a temperature below $T_g$. The higher the thermal stability of the supercooled liquid $\Delta T_x$, the longer the available time $t_o$, which allows for application of the deformational force for longer periods and thus enables larger shaping strains. Also, the higher the thermal stability of the supercooled liquid $\Delta T_x$, the higher the softening temperature $T_o$ that the metallic glass can be heated, which would result in lower viscosities and thus allow larger shaping strains.

In the disclosure, the supercooling temperature is defined as the difference between the softening temperature $T_o$ and the glass transition temperature $T_g$, i.e. $T_o-T_g$, expressed in units of either ° C. or K. Also, the normalized supercooling temperature is defined as the difference between the softening temperature $T_o$ and the glass transition temperature $T_g$, divided by the glass transition temperature $T_g$, i.e. $(T_o-T_g)/T_g$, expressed in units of K/K.

In some embodiments, $T_o$ is higher than $T_g$ and lower than the liquidus temperature of the metallic glass-forming alloy. In one embodiment, $T_o$ is greater than $T_g$ and lower than $T_x$. In another embodiment, $T_o$ is higher than $T_x$ and lower than the solidus temperature of the metallic glass-forming alloy. The liquidus temperature is the temperature above which a metallic glass-forming alloy is an equilibrium liquid. The solidus temperature is the temperature above which the crystalline state of the metallic glass-forming alloy begins to melt.

In another embodiment, $T_o$ is in the range of 500 to 800° C. In another embodiment, $T_o$ is in the range of 525 to 700° C. In another embodiment, $T_o$ is in the range of 550 to 650° C. In another embodiment, $T_o$ is such that the supercooling temperature is in the range of 190 to 260° C. In another embodiment, $T_o$ is such that the supercooling temperature is in the range of 200 to 250° C. In another embodiment, $T_o$ is such that the supercooling temperature is in the range of 210 to 240° C. In another embodiment, $T_o$ is such that the normalized supercooling temperature is in the range of 0.3 to 0.4. In another embodiment, $T_o$ is such that the normalized supercooling temperature is in the range of 0.31 to 0.39. In another embodiment, $T_o$ is such that the normalized supercooling temperature is in the range of 0.32 to 0.38. In some embodiments, the viscosity at $T_o$ is less than $10^5$ Pa-s. In one embodiment, the viscosity at $T_o$ is in the range of $10^0$ to $10^5$ Pa-s. In another embodiment, the viscosity at $T_o$ is in the range of $10^1$ to $10^4$ Pa-s.

In addition to exhibiting large thermal stability of the supercooled liquid $\Delta T_x$, the metallic glasses can be capable of being formed in bulk (i.e. millimeter-thick) dimensions in order to enable "thermoplastic" shaping of bulk 3-dimensional articles. That is, metallic glasses having both a high glass-forming ability as well as a large $\Delta T_x$ would be suitable for "thermoplastic" shaping of bulk articles. Discovering compositional regions where the metallic glass demonstrates a high glass forming ability is unpredictable. Discovering compositional regions where the metallic glass demonstrates a large $\Delta T_x$ is equally unpredictable. Discovering compositional regions where the metallic glass demonstrates both a high glass forming ability and a large $\Delta T_x$ is even more unpredictable than both cases above, because metallic glasses that demonstrate a high glass forming ability do not necessarily demonstrate a large $\Delta T_x$, and vice versa. In the context of this disclosure, a critical plate thickness of at least 4 mm and a $\Delta T_x$ of at least 78° C. may be sufficient to enable "thermoplastic" shaping of bulk 3-dimensional articles.

In this disclosure, compositional regions in the Zr—Ti—Cu—Ni—Al alloys are disclosed where the metallic glass-forming alloys demonstrate a high glass forming ability while the metallic glasses formed from the alloys demonstrate a large $\Delta T_x$. In embodiments of the disclosure, the metallic glass-forming alloys demonstrate a critical plate thickness of at least 4 mm, while the metallic glasses formed from the alloys demonstrate a $\Delta T_x$ of at least 78° C. In some embodiments, the critical plate thickness is at least 5 mm, in other embodiments the critical plate thickness is at least 6 mm, while in other embodiments the critical plate thickness is at least 7 mm. In some embodiments, the thermal stability of the supercooled liquid is at least 79° C., in other embodiments at least 80° C., in other embodiments at least 82° C., in other embodiments at least 85° C., while in other embodiments at least 90° C.

The disclosure is also directed to methods of forming a metallic glass, or an article made of a metallic glass, from the metallic glass-forming alloy. In various embodiments, a metallic glass is formed by heating and melting an alloy ingot under inert atmosphere to create a molten alloy, and subsequently quenching the molten alloy fast enough to avoid crystallization of the molten alloy. In one embodiment, prior to cooling the molten alloy is heated to at least 100° C. above the liquidus temperature of the metallic glass-forming alloy. In another embodiment, prior to quenching the molten alloy is heated to at least 200° C. above the liquidus temperature of the metallic glass-forming alloy. In another embodiment, prior to quenching the molten alloy is heated to at least 1100° C. In yet another embodiment, prior to quenching the molten alloy is heated to at least 1200° C. In one embodiment, the alloy ingot is heated and melted using a plasma arc. In another embodiment, the alloy ingot is heated and melted using an induction coil. In some embodiments, the alloy ingot is heated and melted over a water-cooled hearth, or within a water-cooled crucible. In one embodiment, the hearth or crucible is made of copper. In some embodiments, the inert atmosphere comprises argon gas. In some embodiments, quenching of the molten alloy is performed by injecting or pouring the molten alloy into a metal mold. In some embodiments, the mold can be made of copper, brass, or steel, among other materials. In some embodiments, injection of the molten alloy is performed by a pneumatic drive, a hydraulic drive, an electric drive, or a magnetic drive. In some embodiments, pouring the molten alloy into a metal mold is performed by tilting a tandish containing the molten alloy.

The disclosure is also directed to methods of thermoplastically shaping a metallic glass into an article. In some embodiments, heating of the metallic glass is performed by conduction to a hot surface. In other embodiments, heating of the metallic glass to a softening temperature $T_o$ above the glass transition temperature $T_g$ is performed by inductive heating. In yet other embodiments, heating of the metallic glass to a softening temperature $T_o$ above the glass transition temperature $T_g$ is performed by ohmic heating. In one embodiment, the ohmic heating is performed by the discharge of at least one capacitor. In some embodiments, the application of the deformational force to thermoplastically shape the softened metallic glass in the supercooled liquid region is performed by a pneumatic drive, a hydraulic drive, an electric drive, or a magnetic drive.

Description of the Metallic Glass Forming Region

In various embodiments, the disclosure provides Zr—Ti—Cu—Ni—Al alloys capable of forming metallic glasses. The alloys demonstrate a critical plate thickness of at least 4 mm, and the metallic glasses demonstrate a thermal stability of the supercooled liquid of at least 78° C.

Specifically, the disclosure provides Zr—Ti—Cu—Ni—Al metallic glass-forming alloys and metallic glasses where Ti ranges over a relatively narrow range, over which the alloys demonstrate a critical plate thickness of at least 4 mm and 6 mm or higher, while the metallic glasses formed from the alloys demonstrate a thermal stability of the supercooled liquid of at least 78° C. and 96° C. or higher. In some embodiments, the Ti range is from 0.5 to less than 4 atomic percent, in other embodiments the Ti range is from 0.5 to 3.9 atomic percent, in other embodiments the Ti range is from 1 to 3.8 atomic percent, in other embodiments the Ti range is from 1.5 to 3.7 atomic percent, in other embodiments the Ti range is from 2 to 3.6 atomic percent, while in other embodiments the Ti range is from 2.5 to 3.5 atomic percent.

In one embodiment, the disclosure provides an alloy capable of forming a metallic glass having a composition represented by the following formula (subscripts denote atomic percentages):

$$Zr_{(100-a-b-c-d)}Ti_aCu_bNi_cAl_d \quad \text{EQ. (1)}$$

where:

a ranges from 0.5 to less than 4;

b ranges from 12 to 20;

c ranges from 9 to 18; and d ranges from 7 to 13, wherein the alloy has a critical plate thickness of at least 4 mm, and wherein the metallic glass has a thermal stability of a supercooled liquid of at least 78° C.

In another embodiment, a ranges from 0.5 to 3.9, b ranges from 13 to 19, c ranges from 10 to 17.5, and d ranges from 8 to 12, wherein the critical plate thickness is at least 4 mm, and wherein the thermal stability of the supercooled liquid is at least 80° C.

In another embodiment, a ranges from 1.5 to 3.7, b ranges from 14 to 18, c ranges from 12 to 17, and d ranges from 8.5 to 11.5, wherein the critical plate thickness is at least 5 mm, and wherein the thermal stability of the supercooled liquid is at least 85° C.

In another embodiment, a ranges from 2.5 to 3.5, b ranges from 15 to 17, c ranges from 13.5 to 16, and d ranges from 9 to 11, wherein the critical plate thickness is at least 6 mm, and wherein the thermal stability of the supercooled liquid is at least 90° C.

Specific embodiments of metallic glasses formed of alloys having compositions according to the formula $Zr_{57.5-x}Ti_xCu_{17.9}Ni_{14.6}Al_{10}$, where the concentration of Ti in the alloys ranges from 1 to less than 4 atomic percent, demonstrate a critical plate thickness of at least 4 mm, while the metallic glasses formed from the alloys demonstrate a thermal stability of the supercooled liquid of at least 78° C.

Figure 2:
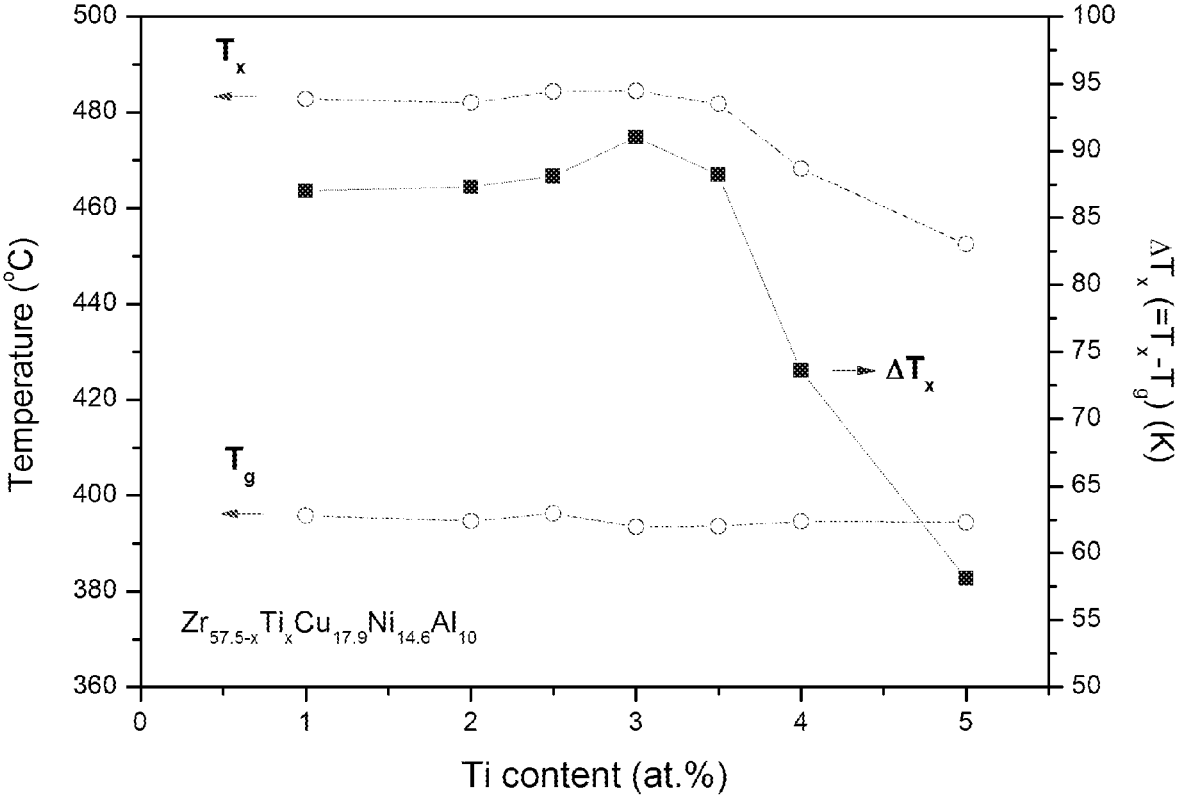
FIG. 2 provides a data plot showing the effect of substituting Zr by Ti according to the composition formula $Zr_{57.5-x}Ti_xCu_{17.9}Ni_{14.6}Al_{10}$ on the glass-transition and crystallization temperatures and thermal stability of the supercooled liquid $\Delta T_x$ in accordance with embodiments of the disclosure.

Specific embodiments of metallic glasses formed of metallic glass-forming alloys with compositions according to the formula $Zr_{57.5-x}Ti_xCu_{17.9}Ni_{14.6}Al_{10}$ are presented in Table 1. In these alloys, Zr is substituted by Ti, where the atomic fraction of Ti varies from 1 to 5 percent, the atomic fraction of Zr varies from 52.5 to 56.5 percent, while the atomic fractions of Cu, Ni, and Al are fixed at 17.9, 14.6, and 10, respectively. FIG. 1 provides calorimetry scans for sample metallic glasses according to the formula $Zr_{57.5-x}Ti_xCu_{17.9}Ni_{14.6}Al_{10}$ in accordance with embodiments of the disclosure. The glass transition temperature $T_g$ and crystallization temperature $T_x$ of the metallic glasses are indicated by arrows in FIG. 1, and are listed in Table 1, along with the difference between crystallization and glass-transition temperatures indicating $\Delta T_x = T_x - T_g$. FIG. 2 provides a data plot showing the effect of substituting Zr by Ti according to the composition formula $Zr_{57.5-x}Ti_xCu_{17.9}Ni_{14.6}Al_{10}$ on the glass-transition and crystallization temperatures and thermal stability of the supercooled liquid $\Delta T_x$ of metallic glasses.

TABLE 1

Sample metallic glasses demonstrating the effect of substituting Zr by Ti according to the formula $Zr_{57.5-x}Ti_xCu_{17.9}Ni_{14.6}Al_{10}$ on the glass-transition and crystallization temperatures and thermal stability of the supercooled liquid $\Delta T_x$

| Example | Composition | $T_g$ (° C.) | $T_x$ (° C.) | $\Delta T_x$ (° C.) |
|---|---|---|---|---|
| 1 | $Zr_{56.5}Ti_1Cu_{17.9}Ni_{14.6}Al_{10}$ | 395.8 | 482.8 | 87.0 |
| 2 | $Zr_{55.5}Ti_2Cu_{17.9}Ni_{14.6}Al_{10}$ | 394.7 | 482.0 | 87.3 |

TABLE 1-continued

Sample metallic glasses demonstrating the effect of substituting Zr by Ti according to the formula $Zr_{57.5-x}Ti_xCu_{17.9}Ni_{14.6}Al_{10}$ on the glass-transition and crystallization temperatures and thermal stability of the supercooled liquid $\Delta T_x$

| Example | Composition | $T_g$ (° C.) | $T_x$ (° C.) | $\Delta T_x$ (° C.) |
|---|---|---|---|---|
| 3 | $Zr_{55}Ti_{2.5}Cu_{17.9}Ni_{14.6}Al_{10}$ | 396.3 | 484.4 | 88.1 |
| 4 | $Zr_{54.5}Ti_3Cu_{17.9}Ni_{14.6}Al_{10}$ | 393.5 | 484.5 | 91.0 |
| 5 | $Zr_{54}Ti_{3.5}Cu_{17.9}Ni_{14.6}Al_{10}$ | 393.6 | 481.8 | 88.2 |
| 6 | $Zr_{53.5}Ti_4Cu_{17.9}Ni_{14.6}Al_{10}$ | 394.6 | 468.2 | 73.6 |
| 7 | $Zr_{52.5}Ti_5Cu_{17.9}Ni_{14.6}Al_{10}$ | 394.4 | 452.5 | 58.1 |

As shown in Table 1 and FIGS. 1 and 2, substituting Zr by Ti according to $Zr_{57.5-x}Ti_xCu_{17.9}Ni_{14.6}Al_{10}$ results in varying thermal stability of the supercooled liquid. The glass-transition temperature $T_g$ decreases from 395.8° C. for the metallic glass containing 1 atomic percent Ti (Example 1), reaches the lowest value of 393.5° C. for the metallic glass containing 3 atomic percent Ti (Example 4), and increases back to 394.4° C. for the metallic glass containing 5 atomic percent Ti (Example 7). The crystallization temperature $T_x$ increases from 482.8° C. for the metallic glass containing 1 atomic percent Ti (Example 1), reaches the highest value of 484.5° C. for the metallic glass containing 3 atomic percent Ti (Example 4), and decreases sharply to 452.5° C. for the metallic glass containing 5 atomic percent Ti (Example 7). The stability for the supercooled liquid $\Delta T_x$ increases from 87.0° C. for the metallic glass containing 1 atomic percent Ti (Example 1), reaches the highest value of 91.0° C. for the metallic glass containing 3 atomic percent Ti (Example 4), and decreases sharply to 58.1° C. for the metallic glass containing 5 atomic percent Ti (Example 7). For example, metallic glasses containing 0.5 atomic percent Ti have the same the glass forming ability and thermal stability as metallic glasses containing 1.0 atomic percent Ti.

The critical plate thicknesses of the example alloys according to the composition formula $Zr_{57.5-x}Ti_xCu_{17.9}Ni_{14.6}Al_{10}$ are listed in Table 2. As shown in Table 2, substituting Zr by Ti according to $Zr_{57.5-x}Ti_xCu_{17.9}Ni_{14.6}Al_{10}$ results in varying glass forming ability. Specifically, the critical plate thickness increases from 4 mm for the metallic glass-forming alloy containing 1 atomic percent Ti (Example 1), reaches the highest value of 5 mm for the metallic glass-forming alloy containing 3 atomic percent Ti (Example 4), and decreases back to 4 mm for the metallic glass-forming alloy containing 5 atomic percent Ti (Example 7)

TABLE 2

Sample metallic glass-forming alloys demonstrating the effect of substituting Zr by Ti according to the formula $Zr_{57.5-x}Ti_xCu_{17.9}Ni_{14.6}Al_{10}$ on the glass forming ability of the alloy

| Example | Composition | Critical Plate thickness [mm] |
|---|---|---|
| 1 | $Zr_{56.5}Ti_1Cu_{17.9}Ni_{14.6}Al_{10}$ | 4 |
| 4 | $Zr_{54.5}Ti_3Cu_{17.9}Ni_{14.6}Al_{10}$ | 5 |
| 7 | $Zr_{52.5}Ti_5Cu_{17.9}Ni_{14.6}Al_{10}$ | 4 |

Figure 3:
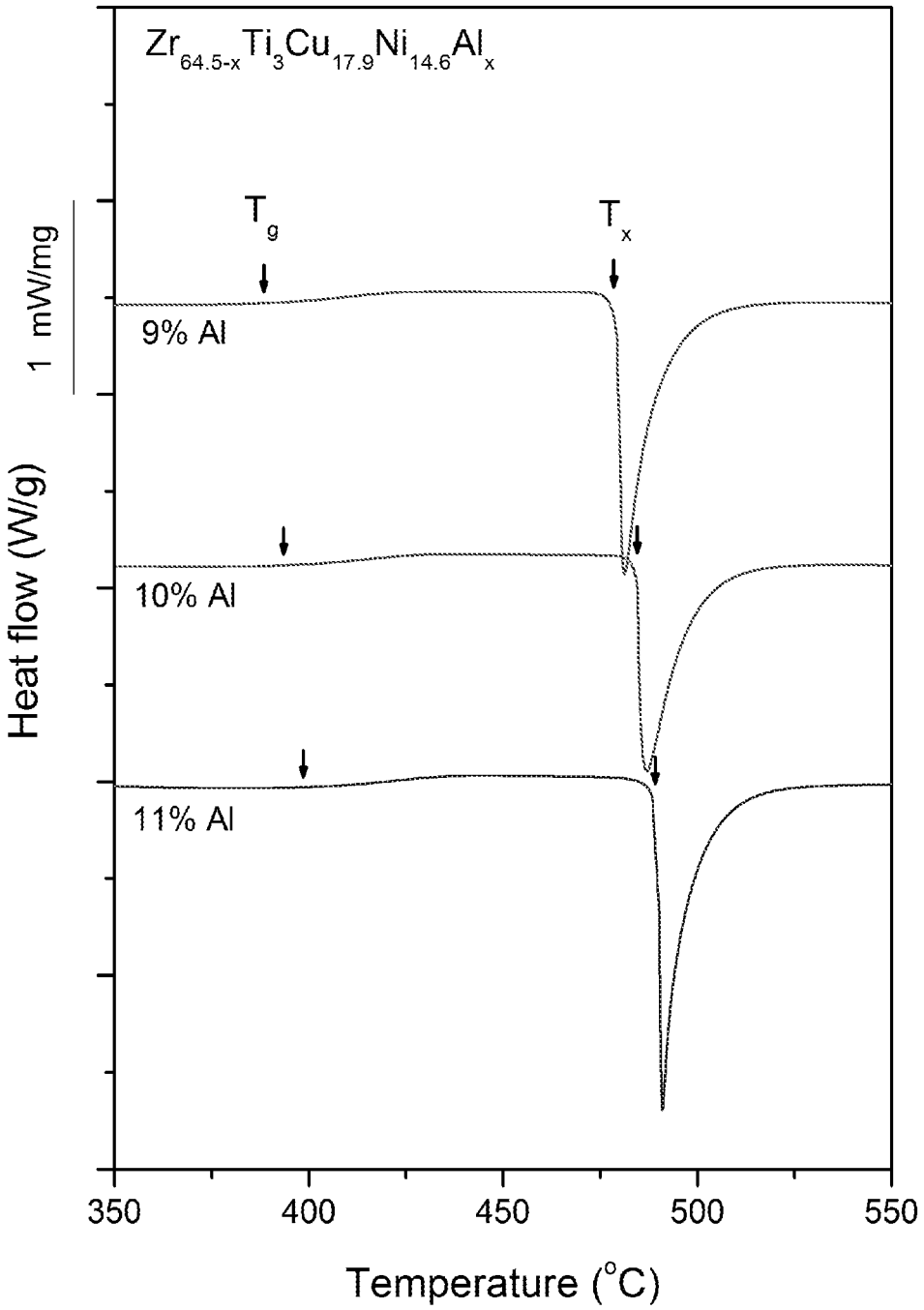
FIG. 3 provides calorimetry scans for sample metallic glasses according to $Zr_{64.5-x}Ti_3Cu_{17.9}Ni_{14.6}Al_x$ in accordance with embodiments of the disclosure. The glass transition temperature $T_g$ and crystallization temperature $T_x$ are indicated by arrows.
Figure 4:
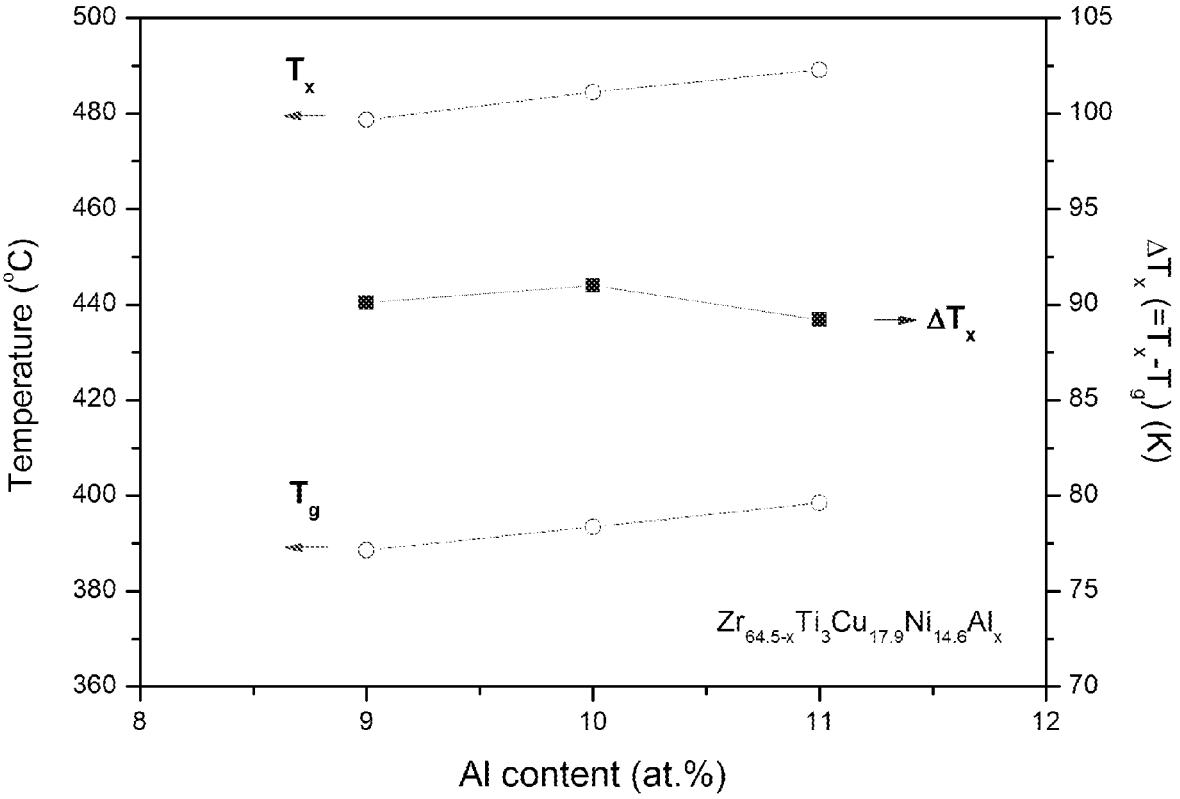
FIG. 4 provides a data plot showing the effect of substituting Zr by Al according to the composition formula $Zr_{64.5-x}Ti_3Cu_{17.9}Ni_{14.6}Al_x$ on the glass-transition and crystallization temperatures and thermal stability of the supercooled liquid $\Delta T_x$ in accordance with embodiments of the disclosure.

Specific embodiments of metallic glasses formed of metallic glass-forming alloys with compositions according to the formula $Zr_{64.5-x}Ti_3Cu_{17.9}Ni_{14.6}Al_x$ are presented in Table 3. In these metallic glass-forming alloys, Zr is substituted by Al, where the atomic fraction of Al varies from 9 to 11 percent, the atomic fraction of Zr varies from 53.5 to 55.5 percent, while the atomic fractions of Ti, Cu, and Ni are fixed at 3, 17.9, and 14.6, respectively. FIG. 3 provides calorimetry scans for sample metallic glasses according to $Zr_{64.5-x}Ti_3Cu_{17.9}Ni_{14.6}Al_x$ in accordance with embodiments of the disclosure. The glass transition temperature $T_g$ and crystallization temperature $T_x$ are indicated by arrows in FIG. 3 and are listed in Table 3, along with the difference between crystallization and glass-transition temperatures $\Delta T_x = T_x - T_g$. FIG. 4 provides a data plot showing the effect of substituting Zr by Al according to the composition formula $Zr_{64.5-x}Ti_3Cu_{17.9}Ni_{14.6}Al_x$ on the glass-transition and crystallization temperatures and thermal stability of the supercooled liquid $\Delta T_x$.

TABLE 3

Sample metallic glasses demonstrating the effect of substituting Zr by Al according to the formula $Zr_{64.5-x}Ti_3Cu_{17.9}Ni_{14.6}Al_x$ on the glass-transition and crystallization temperatures and thermal stability of the supercooled liquid $\Delta T_x$

| Example | Composition | $T_g$ (° C.) | $T_x$ (° C.) | $\Delta T_x$ (° C.) |
|---|---|---|---|---|
| 8 | $Zr_{55.5}Ti_3Cu_{17.9}Ni_{14.6}Al_9$ | 388.6 | 478.7 | 90.1 |
| 4 | $Zr_{54.5}Ti_3Cu_{17.9}Ni_{14.6}Al_{10}$ | 393.5 | 484.5 | 91.0 |
| 9 | $Zr_{53.5}Ti_3Cu_{17.9}Ni_{14.6}Al_{11}$ | 398.5 | 489.2 | 89.2 |

As shown in Table 3 and FIGS. 3 and 4, substituting Zr by Al according to $Zr_{64.5-x}Ti_3Cu_{17.9}Ni_{14.6}Al_x$ does not significantly affect the thermal stability of the supercooled liquid. The glass-transition temperature $T_g$ increases monotonically from 388.6° C. for the metallic glass containing 9 atomic percent Al (Example 8) to 398.5° C. for the metallic glass containing 11 atomic percent Al (Example 9). The crystallization temperature $T_x$ also increases monotonically from 478.7° C. for the metallic glass containing 9 atomic percent Al (Example 8) to 489.2° C. for the metallic glass-forming alloy containing 11 atomic percent Al (Example 9). The stability for the supercooled liquid $\Delta T_x$ increases slightly from 90.1° C. for the metallic glass-forming alloy containing 9 atomic percent Al (Example 8), reaches the highest value of 91.0° C. for the metallic glass-forming alloy containing 10 atomic percent Al (Example 4), and decreases slightly to 89.2° C. for the metallic glass-forming alloy containing 11 atomic percent Al (Example 9).

Figure 5:
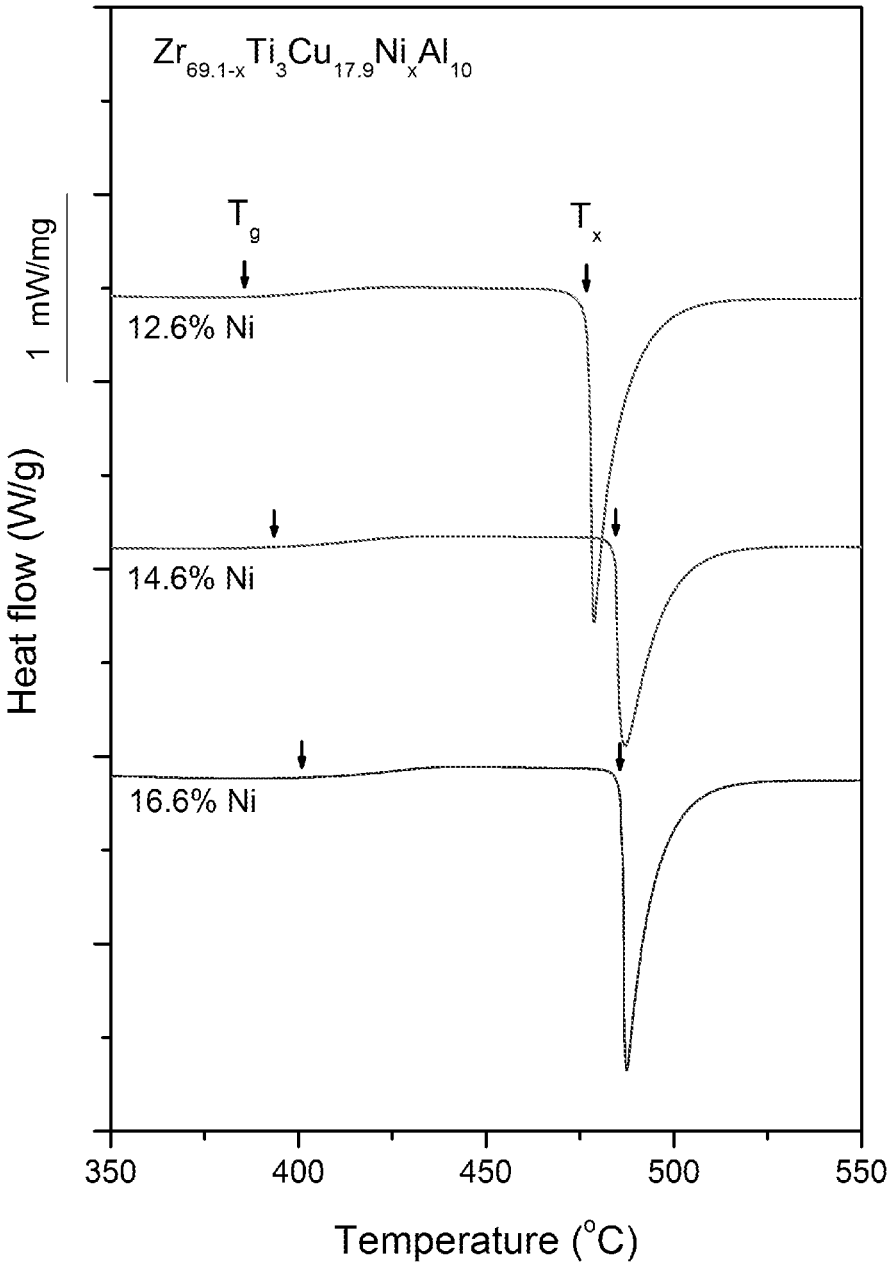
FIG. 5 provides calorimetry scans for sample metallic glasses according to $Zr_{69.1-x}Ti_3Cu_{17.9}Ni_xAl_{10}$ in accordance with embodiments of the disclosure. The glass transition temperature $T_g$ and crystallization temperature $T_x$ are indicated by arrows.
Figure 6:
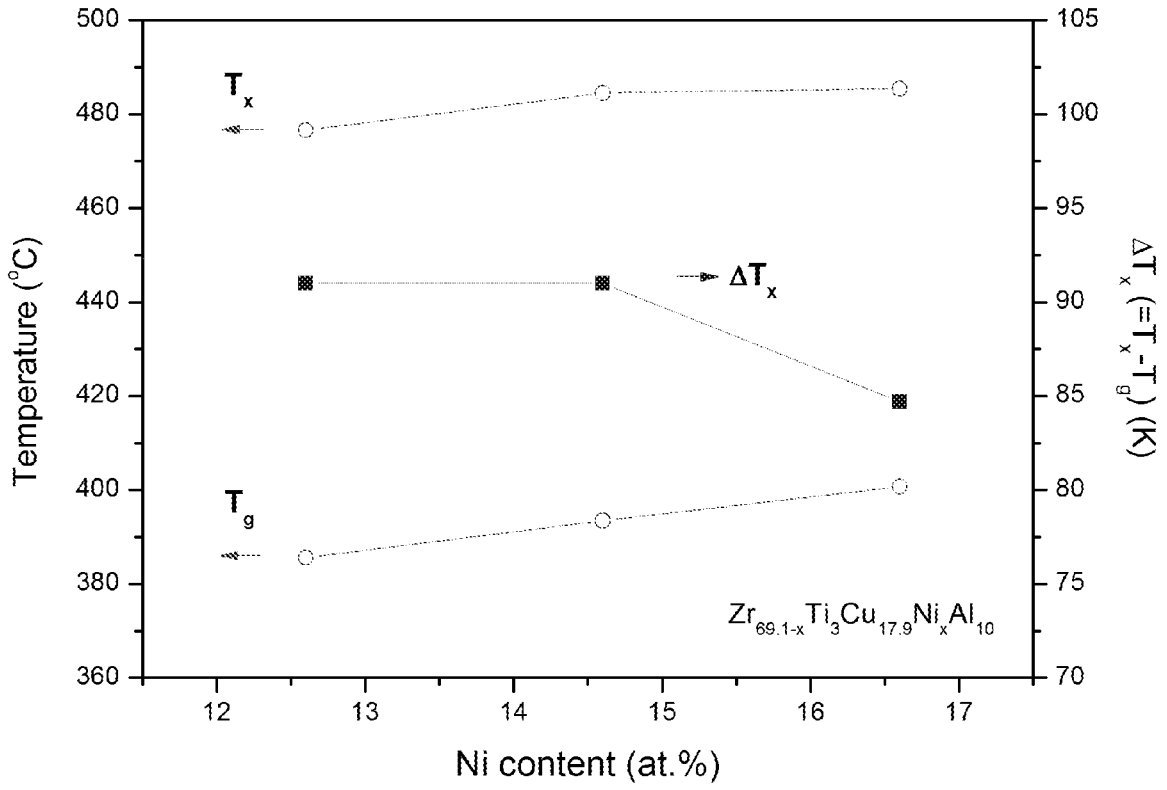
FIG. 6 provides a data plot showing the effect of substituting Zr by Ni according to the composition formula $Zr_{69.1-x}Ti_3Cu_{17.9}Ni_xAl_{10}$ on the glass-transition and crystallization temperatures and thermal stability of the supercooled liquid $\Delta T_x$ in accordance with embodiments of the disclosure.

Specific embodiments of metallic glasses formed of metallic glass-forming alloys with compositions according to the formula $Zr_{69.1-x}Ti_3Cu_{17.9}Ni_xAl_{10}$ are presented in Table 4. In these alloys, Zr is substituted by Ni, where the atomic fraction of Ni varies from 12.6 to 16.6 percent, the atomic fraction of Zr varies from 52.5 to 56.5 percent, while the atomic fractions of Ti, Cu, and Al are fixed at 3, 17.9, and 10, respectively. FIG. 5 provides calorimetry scans for sample metallic glasses according to $Zr_{69.1-x}Ti_3Cu_{17.9}Ni_xAl_{10}$ in accordance with embodiments of the disclosure. The glass transition temperature $T_g$ and crystallization temperature $T_x$ are indicated by arrows in FIG. 5 and are listed in Table 4, along with the difference between crystallization and glass-transition temperatures $\Delta T_x = T_x - T_g$. FIG. 6 provides a data plot showing the effect of substituting Zr by Ni according to the composition formula $Zr_{69.1-x}Ti_3Cu_{17.9}Ni_xAl_{10}$ on the glass-transition and crystallization temperatures and thermal stability of the supercooled liquid $\Delta T_x$.

TABLE 4

Sample metallic glasses demonstrating the effect of substituting Zr by Ni according to the formula $Zr_{69.1-x}Ti_3Cu_{17.9}Ni_xAl_{10}$ on the glass-transition and crystallization temperatures and thermal stability of the supercooled liquid $\Delta T_x$

| Example | Composition | $T_g$ (° C.) | $T_x$ (° C.) | $\Delta T_x$ (° C.) |
|---|---|---|---|---|
| 10 | $Zr_{56.5}Ti_3Cu_{17.9}Ni_{12.6}Al_{10}$ | 385.6 | 476.6 | 91.0 |
| 4 | $Zr_{54.5}Ti_3Cu_{17.9}Ni_{14.6}Al_{10}$ | 393.5 | 484.5 | 91.0 |
| 11 | $Zr_{52.5}Ti_3Cu_{17.9}Ni_{16.6}Al_{10}$ | 400.7 | 485.4 | 84.7 |

As shown in Table 4 and FIGS. 5 and 6, substituting Zr by Ni according to $Zr_{69.1-x}Ti_3Cu_{17.9}Ni_xAl_{10}$ slightly influences the thermal stability of the supercooled liquid. The glass-transition temperature $T_g$ increases monotonically from 385.6° C. for the metallic glass containing 12.6 atomic percent Ni (Example 10) to 400.7° C. for the metallic glass containing 16.6 atomic percent Ni (Example 11). The crystallization temperature $T_x$ also increases monotonically from 476.6° C. for the metallic glass containing 12.6 atomic percent Ni (Example 10) to 485.4° C. for the metallic glass containing 16.6 atomic percent Ni (Example 11). The thermal stability for the supercooled liquid $\Delta T_x$ is unchanged at 91.0° C. for between the metallic glass containing 12.6-14.6 atomic percent Ni (Examples 10 and 4), and decreases to 84.7° C. for the metallic glass containing 16.6 atomic percent Ni (Example 11).

Figure 7:
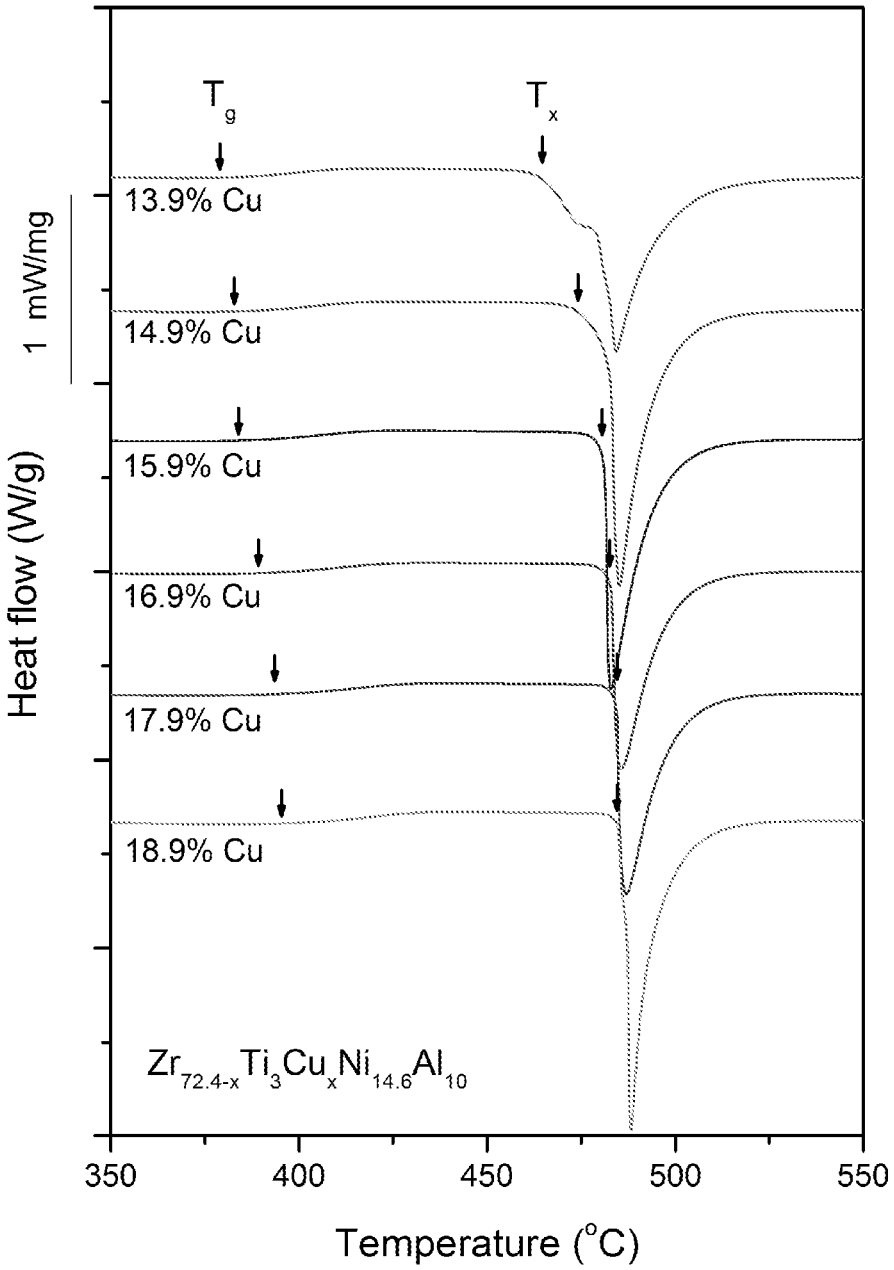
FIG. 7 provides calorimetry scans for sample metallic glasses according to $Zr_{72.4-x}Ti_3Cu_xNi_{14.6}Al_{10}$ in accordance with embodiments of the disclosure. The glass transition temperature $T_g$ and crystallization temperature $T_x$ are indicated by arrows.
Figure 8:
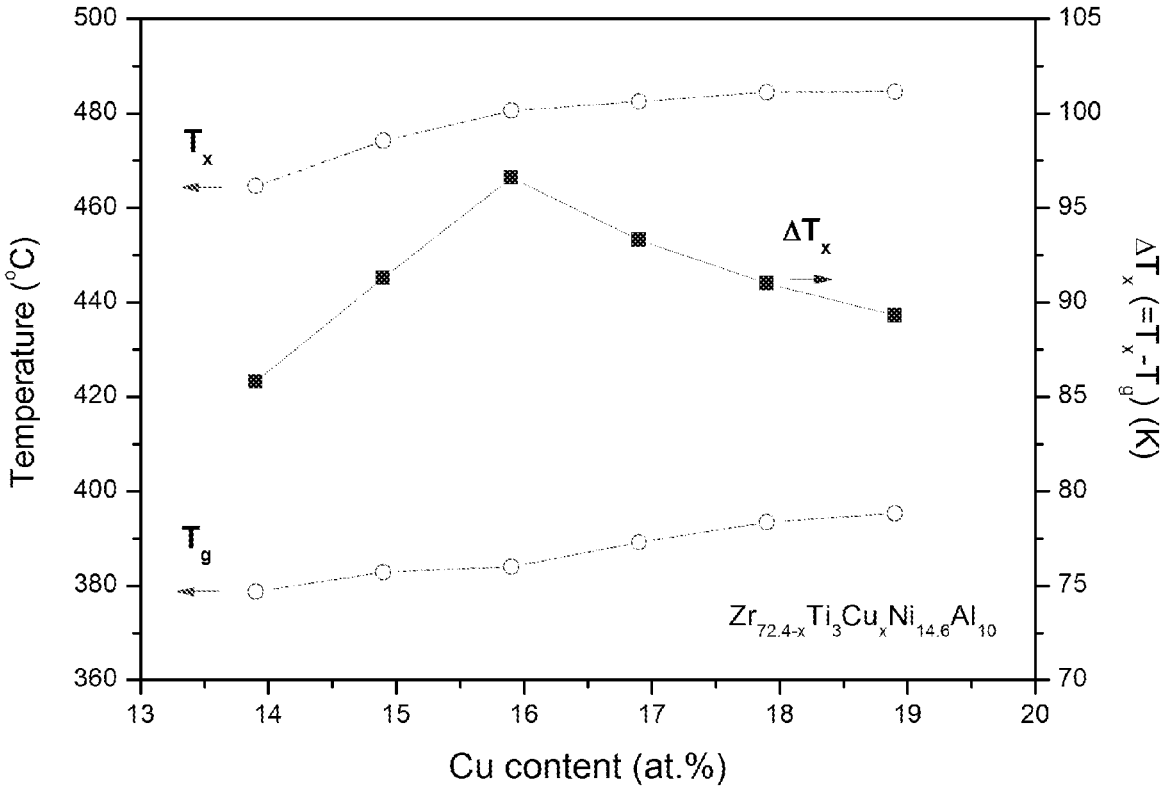
FIG. 8 provides a data plot showing the effect of substituting Zr by Cu according to the composition formula $Zr_{72.4-x}Ti_3Cu_xNi_{14.6}Al_{10}$ on the glass-transition and crystallization temperatures and thermal stability of the supercooled liquid $\Delta T_x$ in accordance with embodiments of the disclosure.

Specific embodiments of metallic glasses formed of metallic glass-forming alloys with compositions according to the formula $Zr_{72.4-x}Ti_3Cu_xNi_{14.6}Al_{10}$ are presented in Table 5. In these metallic glass-forming alloys, Zr is substituted by Cu, the atomic fraction of Cu varies from 13.9 to 18.9 percent, the atomic fraction of Zr varies from 53.5 to 58.5 percent, while the atomic fractions of Ti, Ni, and Al are fixed at 3, 14.6, and 10, respectively. FIG. 7 provides calorimetry scans for sample metallic glasses according to $Zr_{72.4-x}Ti_3Cu_xNi_{14.6}Al_{10}$ in accordance with embodiments of the disclosure. The glass transition temperature $T_g$ and crystallization temperature $T_x$ are indicated by arrows in FIG. 7 and are listed in Table 5, along with the difference between crystallization and glass-transition temperatures $\Delta T_x = T_x - T_g$. FIG. 8 provides a data plot showing the effect of substituting Zr by Cu according to the composition formula $Zr_{72.4-x}Ti_3Cu_xNi_{14.6}Al_{10}$ on the glass-transition and crystallization temperatures and thermal stability of the supercooled liquid $\Delta T_x$.

TABLE 5

Sample metallic glasses demonstrating the effect of substituting Zr by Cu according to the formula $Zr_{72.4-x}Ti_3Cu_xNi_{14.6}Al_{10}$ on the glass-transition and crystallization temperatures and thermal stability of the supercooled liquid $\Delta T_x$

| Example | Composition | $T_g$ (° C.) | $T_x$ (° C.) | $\Delta T_x$ (° C.) |
|---|---|---|---|---|
| 12 | $Zr_{58.5}Ti_3Cu_{13.9}Ni_{14.6}Al_{10}$ | 378.8 | 464.6 | 85.8 |
| 13 | $Zr_{57.5}Ti_3Cu_{14.9}Ni_{14.6}Al_{10}$ | 382.9 | 474.2 | 91.3 |
| 14 | $Zr_{56.5}Ti_3Cu_{15.9}Ni_{14.6}Al_{10}$ | 384.0 | 480.6 | 96.6 |
| 15 | $Zr_{55.5}Ti_3Cu_{16.9}Ni_{14.6}Al_{10}$ | 389.2 | 482.5 | 93.3 |
| 4 | $Zr_{54.5}Ti_3Cu_{17.9}Ni_{14.6}Al_{10}$ | 393.5 | 484.5 | 91.0 |
| 16 | $Zr_{53.5}Ti_3Cu_{18.9}Ni_{14.6}Al_{10}$ | 395.3 | 484.6 | 89.3 |

As shown in Table 5 and FIGS. 7 and 8, substituting Zr by Cu according to $Zr_{72.4-x}Ti_3Cu_xNi_{14.6}Al_{10}$ results in a varying thermal stability of the supercooled liquid. The glass-transition temperature $T_g$ increases monotonically from 378.8° C. for the metallic glass containing 13.9 atomic percent Cu (Example 12) to 395.3° C. for the metallic glass containing 18.9 atomic percent Cu (Example 16). The crystallization temperature $T_x$ also increases monotonically from 464.6° C. for the metallic glass containing 13.9 atomic percent Cu (Example 12) to 484.6° C. for the metallic glass containing 18.9 atomic percent Cu (Example 16). The thermal stability for the supercooled liquid $\Delta T_x$ increases significantly from 85.8° C. for the metallic glass containing 13.9 atomic percent Cu (Example 12), reaches the highest value of 96.6° C. for the metallic glass containing 15.9 atomic percent Cu (Example 14), and decreases back to 89.3° C. for the metallic glass containing 18.9 atomic percent Cu (Example 16).

Specific embodiments of metallic glasses formed of metallic glass-forming alloys with compositions according to the formula $Zr_{71.1-x}Ti_3Cu_{15.9}Ni_xAl_{10}$ are presented in Table 6. In these metallic glass-forming alloys, Zr is substituted by Ni, the atomic fraction of Ni varies from 10.6 to 14.6 percent, the atomic fraction of Zr varies from 56.5 to 60.5 percent, while the atomic fractions of Ti, Cu, and Al are fixed at 3, 15.9, and 10, respectively. The glass transition temperature $T_g$ and crystallization temperature $T_x$ of metallic glasses are listed in Table 6, along with the difference between crystallization and glass-transition temperatures $\Delta T_x = T_x - T_g$.

TABLE 6

Sample metallic glasses demonstrating the effect of substituting Zr by Ni according to the formula $Zr_{71.1-x}Ti_3Cu_{15.9}Ni_xAl_{10}$ on the glass-transition and crystallization temperatures and thermal stability of the supercooled liquid $\Delta T_x$

| Example | Composition | $T_g$ (° C.) | $T_x$ (° C.) | $\Delta T_x$ (° C.) |
|---|---|---|---|---|
| 14 | $Zr_{56.5}Ti_3Cu_{15.9}Ni_{14.6}Al_{10}$ | 384.0 | 480.6 | 96.6 |
| 17 | $Zr_{57.5}Ti_3Cu_{15.9}Ni_{13.6}Al_{10}$ | 380.6 | 468.9 | 88.3 |
| 18 | $Zr_{58.5}Ti_3Cu_{15.9}Ni_{12.6}Al_{10}$ | 376.7 | 459.7 | 83.0 |
| 19 | $Zr_{60.5}Ti_3Cu_{15.9}Ni_{10.6}Al_{10}$ | 367.5 | 446.5 | 79.0 |

The critical plate thicknesses of the example metallic glass-forming alloys according to the composition formula $Zr_{71.1-x}Ti_3Cu_{15.9}Ni_xAl_{10}$ are listed in Table 7. As shown in Table 7, substituting Zr by Ni according to $Zr_{71.1-x}Ti_3Cu_{15.9}Ni_xAl_{10}$ results in a fairly constant glass forming ability. Specifically, the critical plate thickness of the metallic glass-forming alloy is 6 mm when the atomic concentration of Ni is between 12.6 and 14.6 (Example 14 and 18), while the critical plate thickness of the metallic glass-forming alloy slightly increases to 7 mm when the atomic concentration of Ni is 10.6 (Example 19).

TABLE 7

Example metallic glass-forming alloys demonstrating the effect of substituting Zr by Ni according to the formula $Zr_{71.1-x}Ti_3Cu_{15.9}Ni_xAl_{10}$ on the glass forming ability of the alloy

| Example | Composition | Critical Plate thickness [mm] |
|---|---|---|
| 14 | $Zr_{56.5}Ti_3Cu_{15.9}Ni_{14.6}Al_{10}$ | 6 |
| 18 | $Zr_{58.5}Ti_3Cu_{15.9}Ni_{12.6}Al_{10}$ | 6 |
| 19 | $Zr_{60.5}Ti_3Cu_{15.9}Ni_{10.6}Al_{10}$ | 7 |

Other embodiments of metallic glasses formed of glass-forming alloys according to the disclosure are presented in Table 8. The glass transition temperature $T_g$ and crystallization temperature $T_x$ of metallic glasses are listed in Table 6, along with the difference between the crystallization and glass-transition temperatures, $\Delta T_x = T_x - T_g$.

TABLE 8

Glass-transition and crystallization temperatures of various sample metallic glasses and thermal stability of the supercooled liquid $\Delta T_x$ according to embodiments of the disclosure

| Example | Composition | $T_g$ (° C.) | $T_x$ (° C.) | $\Delta T_x$ (° C.) |
|---|---|---|---|---|
| 20 | $Zr_{61.5}Ti_2Cu_{15.9}Ni_{10.6}Al_{10}$ | 374 | 486 | 112 |
| 21 | $Zr_{56}Ti_3Cu_{16}Ni_{15}Al_{10}$ | 389.0 | 482.7 | 93.7 |
| 22 | $Zr_{56}Ti_{3.5}Cu_{15.9}Ni_{14.6}Al_{10}$ | 383.8 | 472.8 | 89 |

Figure 9:
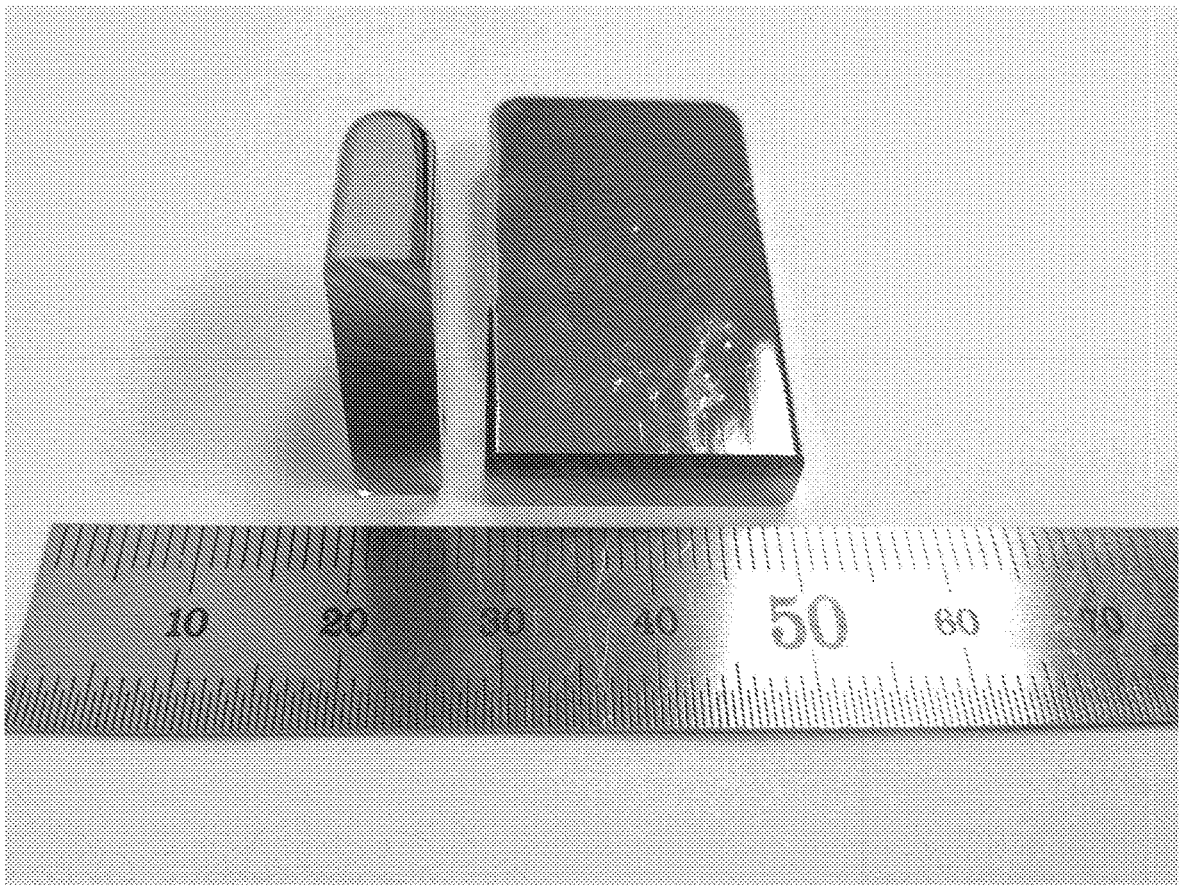
FIG. 9 provides an image of a 6-mm thick metallic glass plate with composition $Zr_{56.5}Ti_3Cu_{15.9}Ni_{14.6}Al_{10}$ (Example 14) in accordance with embodiments of the disclosure.
Figure 10:
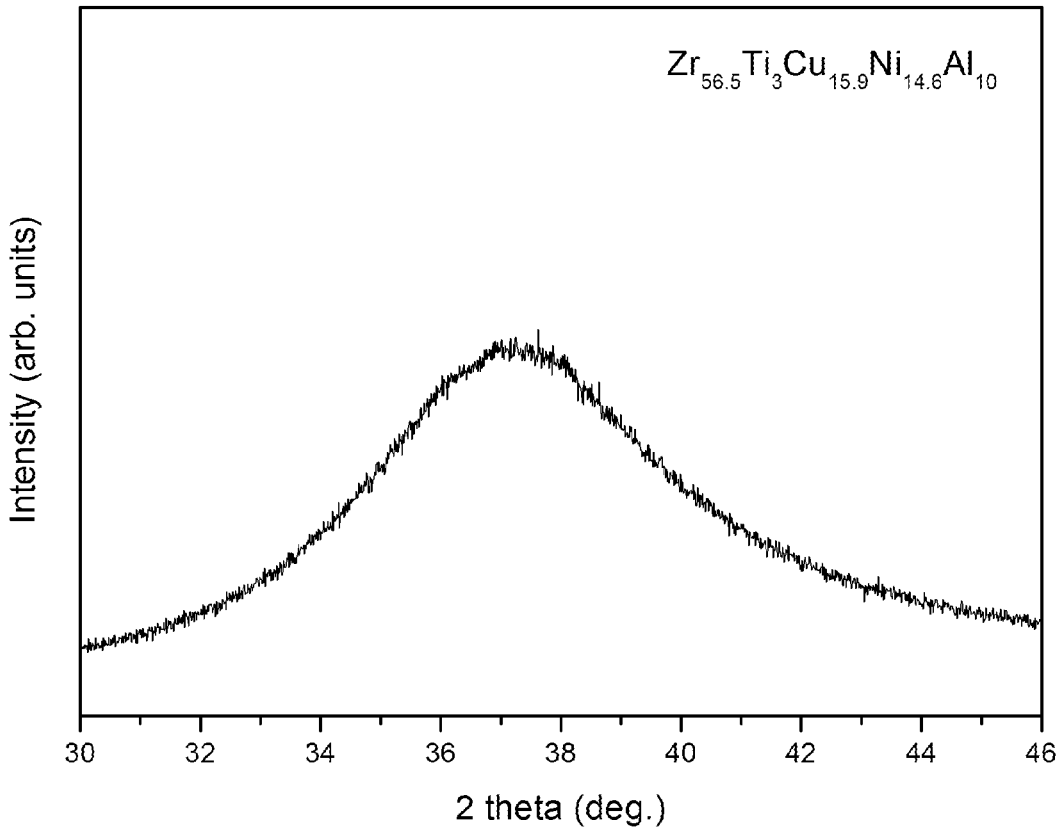
FIG. 10 provides an x-ray diffractogram verifying the amorphous structure of a 6-mm thick metallic glass plate with composition $Zr_{56.5}Ti_3Cu_{15.9}Ni_{14.6}Al_{10}$ (Example 14) in accordance with embodiments of the disclosure.

As shown in Tables 1-5, and FIGS. 1-8, metallic glass $Zr_{56.5}Ti_3Cu_{15.9}Ni_{14.6}Al_{10}$ (Example 14) has the largest thermal stability of the supercooled liquid, having a $\Delta T_x$ of 96.6° C. This metallic glass-forming alloy also demonstrates a high glass forming ability, having a critical plate thickness of 6 mm. FIG. 9 provides an image of a 6-mm thick metallic glass plate with composition $Zr_{56.5}Ti_3Cu_{15.9}Ni_{14.6}Al_{10}$ (Example 14). FIG. 10 provides an x-ray diffractogram verifying the amorphous structure of a 6-mm thick metallic glass plate with composition $Zr_{56.5}Ti_3Cu_{15.9}Ni_{14.6}Al_{10}$ (Example 14).

Figure 11:
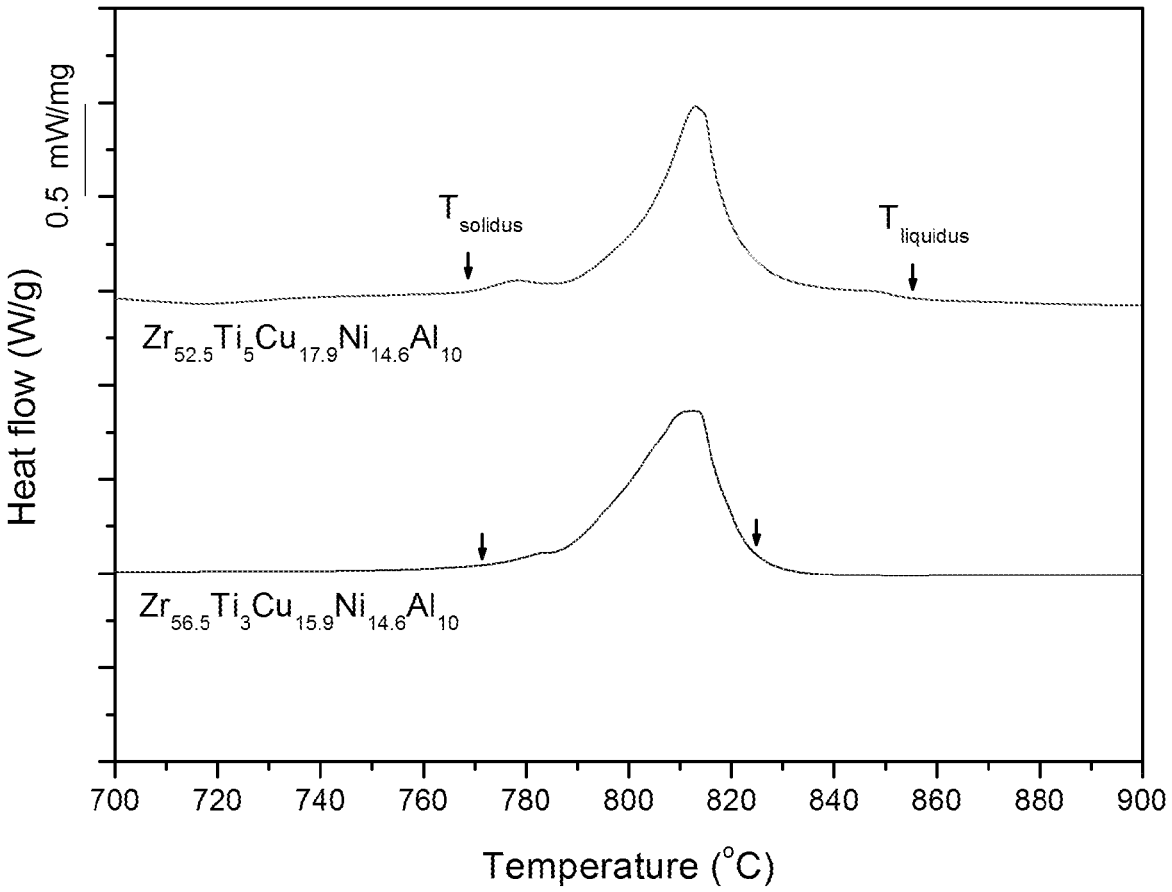
FIG. 11 provides calorimetry scans near the melting transition for sample metallic glass $Zr_{52.5}Ti_5Cu_{17.9}Ni_{14.6}Al_{10}$ (Example 7) and for sample metallic glass $Zr_{56.5}Ti_3Cu_{15.9}Ni_{14.6}Al_{10}$ (Example 14) in accordance with embodiments of the disclosure. The solidus temperature $T_s$, and liquidus temperature $T_l$ are indicated by arrows.

The higher glass forming ability demonstrated by the metallic glass-forming alloys of the disclosure compared to known alloys may be attributed to a significantly lower liquidus temperature of the present metallic glass-forming alloys. FIG. 11 provides calorimetry scans near the melting transition for sample metallic glass $Zr_{52.5}Ti_5Cu_{17.9}Ni_{14.6}Al_{10}$ (Example 7), which is a known metallic glass, and for sample metallic glass $Zr_{56.5}Ti_3Cu_{15.9}Ni_{14.6}Al_{10}$ (Example 14), which is in accordance with embodiments of the disclosure. The solidus temperature $T_s$ and liquidus temperature $T_l$ of the metallic glass-forming alloys are indicated by arrows in FIG. 11 and are listed in Table 9, along with the critical plate thickness.

TABLE 9

Solidus and liquidus temperatures and critical plate thickness of sample metallic glass-forming alloys $Zr_{52.5}Ti_5Cu_{17.9}Ni_{14.6}Al_{10}$ and $Zr_{56.5}Ti_3Cu_{15.9}Ni_{14.6}Al_{10}$

| Example | Composition | $T_s$ (° C.) | $T_l$ (° C.) | Critical Plate thickness [mm] |
|---|---|---|---|---|
| 7 | $Zr_{52.5}Ti_5Cu_{17.9}Ni_{14.6}Al_{10}$ | 769.2 | 855.2 | 4 |
| 14 | $Zr_{56.5}Ti_3Cu_{15.9}Ni_{14.6}Al_{10}$ | 770.7 | 824.5 | 6 |

As seen in FIG. 11 and Table 9, the solidus temperature of the metallic glass-forming alloy $Zr_{52.5}Ti_5Cu_{17.9}Ni_{14.6}Al_{10}$ (Example 7) is approximately equal to that of the glass-forming alloy $Zr_{56.5}Ti_3Cu_{15.9}Ni_{14.6}Al_{10}$ (Example 14), having a value of about 770° C. However, the liquidus temperature of the metallic glass-forming alloy $Zr_{52.5}Ti_5Cu_{17.9}Ni_{14.6}Al_{10}$ (Example 7) is considerably higher than that of metallic glass-forming alloy $Zr_{56.5}Ti_3Cu_{15.9}Ni_{14.6}Al_{10}$ (Example 14). Specifically, the liquidus temperature of the metallic glass-forming alloy $Zr_{52.5}Ti_5Cu_{17.9}Ni_{14.6}Al_{10}$ (Example 7) of 855.2° C. is more than 30° C. higher than the liquidus temperature of metallic glass-forming alloy $Zr_{56.5}Ti_3Cu_{15.9}Ni_{14.6}Al_{10}$ (Example 14) of 824.5° C. The lower liquidus temperature of the metallic glass-forming alloy $Zr_{56.5}Ti_3Cu_{15.9}Ni_{14.6}Al_{10}$ (Example 14) may explain its higher glass-forming ability. Specifically, the critical plate thickness of metallic glass-forming alloy $Zr_{56.5}Ti_3Cu_{15.9}Ni_{14.6}Al_{10}$ (Example 14) of 6 mm is 50% higher than the critical plate thickness of metallic glass-forming alloy $Zr_{52.5}Ti_5Cu_{17.9}Ni_{14.6}Al_{10}$ (Example 7) of 4 mm. Therefore, in some embodiments of the disclosure, the liquidus temperature of the metallic glass-forming alloy is below 850° C., in other embodiments below 845° C., in other embodiments below 840° C., in other embodiments below 835° C., while in other embodiments below 830° C.

Isothermal Crystallization Kinetics

To demonstrate the ability of the disclosed metallic glasses to resist crystallization at high softening temperatures deep into the supercooled liquid region, isothermal crystallization experiments were performed. Such experiments enable determination of the time for crystallization, $t_o$, at a given softening temperature, $T_o$, where the metallic glass is heated to. Sampling $t_o$ at various $T_o$ enables construction of a TTT (Time-Temperature-Transformation diagram). These experiments were performed on two metallic glasses: $Zr_{52.5}Ti_5Cu_{17.9}Ni_{14.6}Al_{10}$ (Example 7) which is a known metallic glass, and $Zr_{60.5}Ti_3Cu_{15.9}Ni_{10.6}Al_{10}$ (Example 19), which is according to embodiments of the disclosure.

The heating experiments to heat the metallic glass in millisecond time scales to a softening temperature $T_o$ that is uniform across the sample and constant with time were performed by ohmic heating via capacitive discharge. Attaining a uniform and constant temperature is necessary in order to alloy the metallic glass to crystallize isothermally by homogeneous nucleation. A high-speed infrared camera was employed to ensure that the temperature remained uniform through the sample during the isothermal time interval, and that the crystallization was initiated by homogeneous nucleation. Multiple experiments were performed for metallic glasses $Zr_{52.5}Ti_5Cu_{17.9}Ni_{14.6}Al_{10}$ and $Zr_{60.5}Ti_3Cu_{15.9}Ni_{10.6}Al_{10}$, where various capacitive energies were used for each metallic glass to reach various softening temperatures $T_o$.

Figure 12:
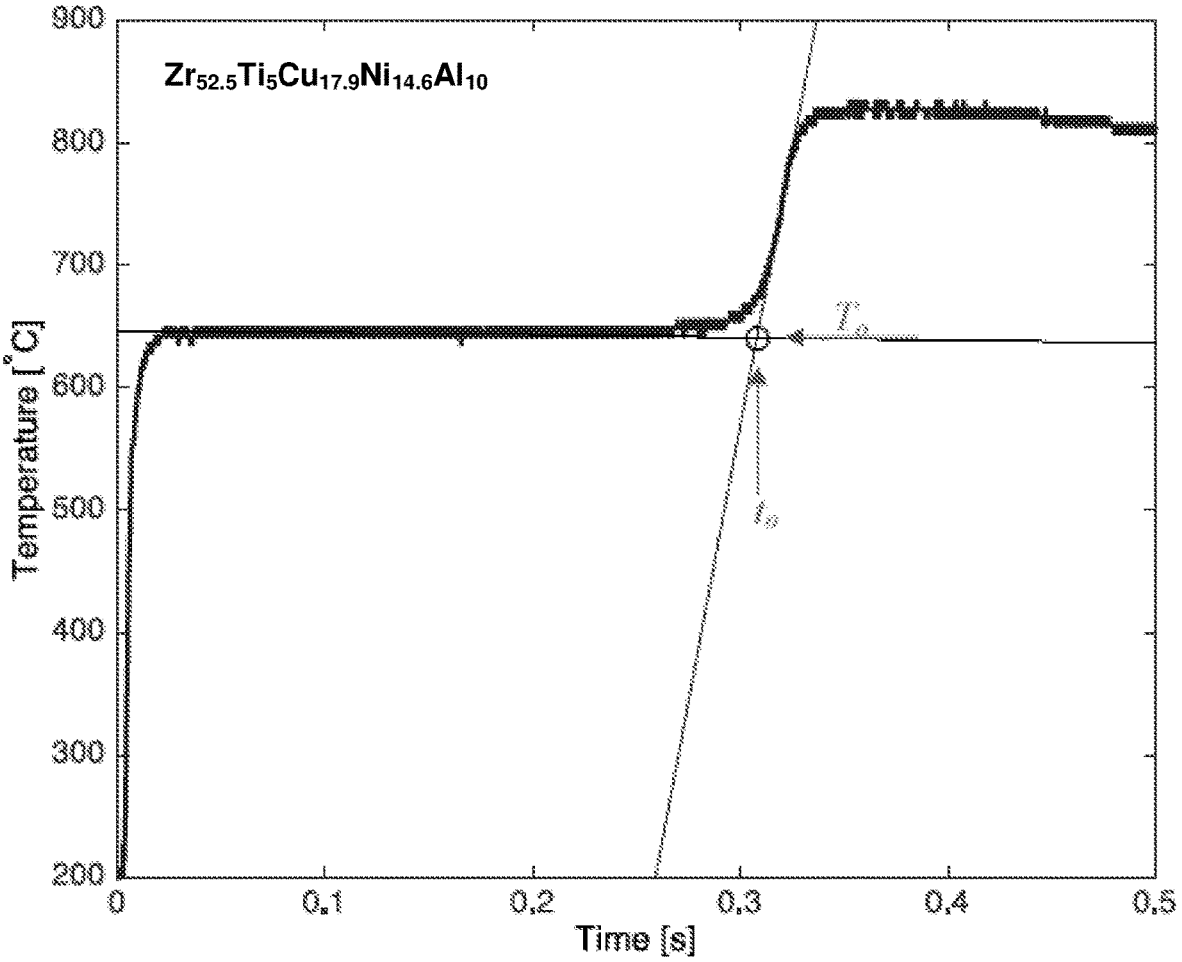
FIG. 12 provides a plot of an example heating curve for metallic glass $Zr_{52.5}Ti_5Cu_{17.9}Ni_{14.6}Al_{10}$ in accordance with embodiments of the disclosure.

A plot of an example heating curve for metallic glass $Zr_{52.5}Ti_5Cu_{17.9}Ni_{14.6}Al_{10}$ is presented FIG. 12. As seen in the plot, the metallic glass is uniformly heated to a softening temperature $T_o$=645.1° C. in about 25 ms. The metallic glass temperature remains constant at about 645° C. for a finite time until crystallization occurs at $t_o$ of 0.308 s, as marked by the onset of recalescence (heating of the sample due to latent heat release). The onset of recalescence is determined graphically by the method of intersecting tangents, as shown in FIG. 12. The crystallization onset times $t_o$ are then determined from the intersecting tangents in the heating curves, as shown in FIG. 12. The $T_o$ and $t_o$ data for metallic glasses $Zr_{52.5}Ti_5Cu_{17.9}Ni_{14.6}Al_{1.0}$ (Example 7) and $Zr_{60.5}Ti_3Cu_{15.9}Ni_{10.6}Al_{10}$ (Example 19) are listed in Tables 10 and 11, respectively.

TABLE 10

Temperature, supercooling temperature, and normalized supercooling temperature against crystallization time for the isothermal crystallization of metallic glass $Zr_{52.5}Ti_5Cu_{17.9}Ni_{14.6}Al_{10}$ (Example 7) upon heating

| Softening Temperature $T_o$ (° C.) | Supercooling Temperature $T_o$-$T_g$ (° C.) | Normalized Supercooling Temperature $(T_o-T_g)/T_g$ (K/K) | Crystallization Time $t_o$ (s) |
|---|---|---|---|
| 671.4 | 277.4 | 0.416 | 0.2060 |
| 657.4 | 263.4 | 0.395 | 0.0969 |
| 645.1 | 251.1 | 0.376 | 0.3080 |
| 641.5 | 247.5 | 0.371 | 0.2474 |
| 617.4 | 223.4 | 0.335 | 0.2278 |
| 607.0 | 213.0 | 0.319 | 0.3569 |

TABLE 11

Temperature, supercooling temperature, and normalized supercooling temperature against crystallization time for the isothermal crystallization of metallic glass $Zr_{60.5}Ti_3Cu_{15.9}Ni_{10.6}Al_{10}$ (Example 19) upon heating

| Softening Temperature $T_o$ (° C.) | Supercooling Temperature $T_o$-$T_g$ (° C.) | Normalized Supercooling Temperature $(T_o-T_g)/T_g$ (K/K) | Crystallization Time $t_o$ (s) |
|---|---|---|---|
| 667.1 | 299.1 | 0.467 | 0.1804 |
| 654.1 | 286.1 | 0.446 | 0.0870 |
| 652.2 | 284.2 | 0.443 | 0.1075 |
| 641.0 | 273.0 | 0.426 | 0.0955 |
| 634.7 | 266.7 | 0.416 | 0.2694 |
| 633.9 | 265.9 | 0.415 | 0.2354 |

To compare the resistance of each metallic glass against crystallization in the supercooled liquid region, a temperature scale should be used that express the softening temperature $T_o$ in relation to the glass transition temperature $T_g$, such that the thermal stability of the supercooled liquid is quantified.

Figure 13:
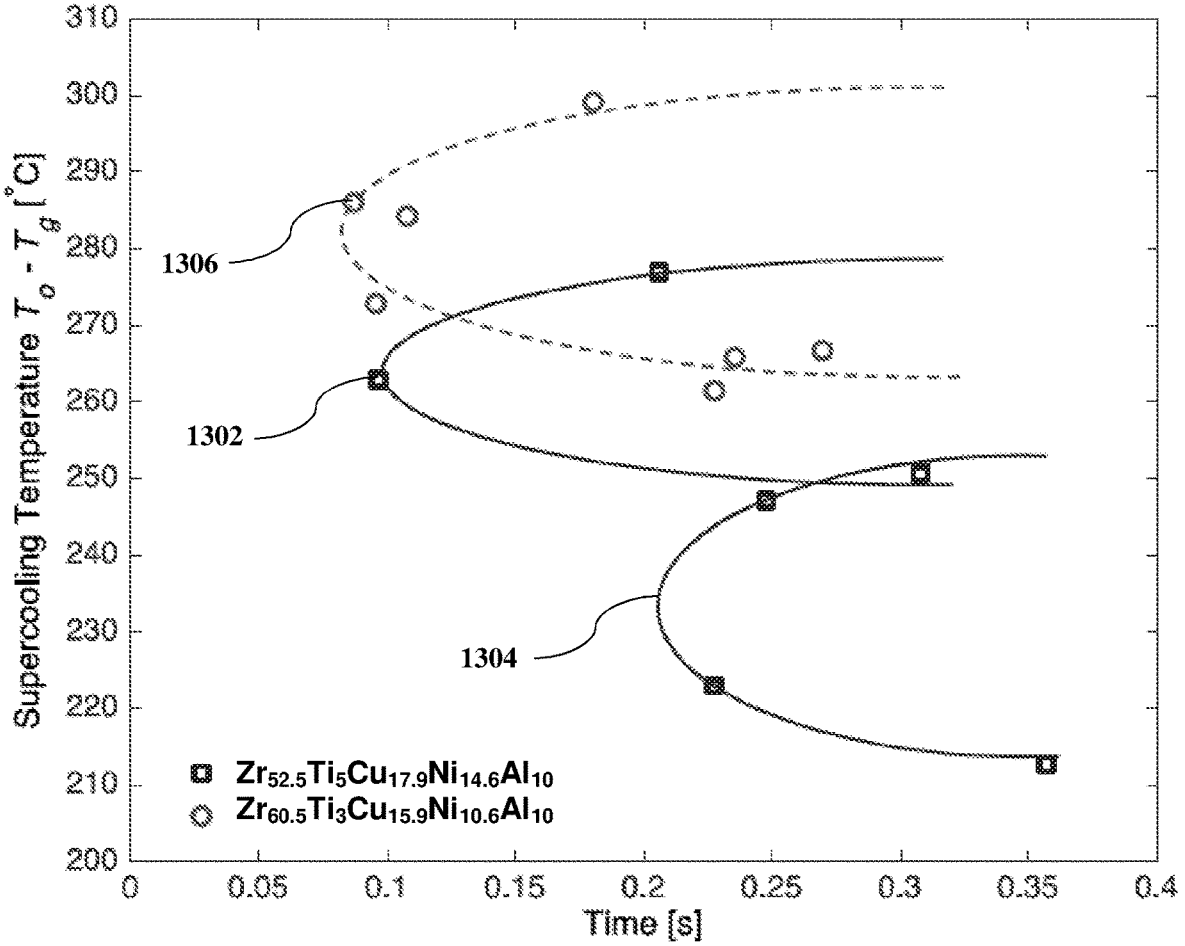
FIG. 13 provides TTT diagrams for metallic glasses $Zr_{52.5}Ti_5Cu_{17.9}Ni_{14.6}Al_{10}$ and $Zr_{60.5}Ti_3Cu_{15.9}Ni_{10.6}Al_{10}$ in accordance with embodiments of the disclosure.

In one embodiment, a temperature scale quantifying the thermal stability of the supercooled liquid is represented by the supercooling temperature, defined as the difference between the softening temperature $T_o$ and the glass transition temperature $T_g$, i.e. $T_o-T_g$, expressed in units of either ° C. or K. The supercooling temperatures for metallic glasses $Zr_{52.5}Ti_5Cu_{17.9}Ni_{14.6}Al_{10}$ (Example 7) and $Zr_{60.5}Ti_3Cu_{15.9}Ni_{10.6}Al_{10}$ (Example 19) are listed in Tables 10 and 11, respectively. The TTT diagrams, where the temperature axis is represented by the supercooling temperature for metallic glasses $Zr_{52.5}Ti_5Cu_{17.9}Ni_{14.6}Al_{10}$ (Example 7) and $Zr_{60.5}Ti_3Cu_{15.9}Ni_{10.6}Al_{10}$ (Example 19), are plotted in FIG. 13. As seen in Tables 10 and 11 and FIG. 13, the TTT diagram of metallic glass $Zr_{52.5}Ti_5Cu_{17.9}Ni_{14.6}Al_{10}$ (Example 7) includes two nose curves: a first curve 1302 at a higher temperature with a nose at a supercooling temperature of about 265° C. and time of about 0.1 s, and a second curve 1304 at a lower temperature with a nose at a supercooling temperature of about 235° C. and time of about 0.1 s. In contrast, the TTT diagram of metallic glass $Zr_{60.5}Ti_3Cu_{15.9}Ni_{10.6}Al_{10}$ includes only one nose curve 1306 at a relatively high temperature, with a nose at a supercooling temperature of about 280° C. and time of about 0.08 s. The lack of a second, lower temperature TTT nose for $Zr_{60.5}Ti_3Cu_{15.9}Ni_{10.6}Al_{10}$ (Example 19) suggests that the supercooled liquid region of this metallic glass is very stable against crystallization, as metallic glass samples fail to crystallize at supercooling temperatures below about 250° C. for a time of at least 1 s. On the other hand, at supercooling temperatures below 250° C. and as low as 213° C., metallic glass $Zr_{52.5}Ti_5Cu_{17.9}Ni_{14.6}Al_{10}$ (Example 7) crystallizes in times as short as 0.38 s.

Therefore, metallic glasses according to some embodiments of the disclosure, when heated at supercooling temperatures below 250° C., can resist isothermal crystallization for at least 0.5 s. Metallic glasses according to other embodiments of the disclosure, when heated at supercooling temperatures below 250° C., can resist isothermal crystallization for at least 0.7 s. Metallic glasses according to yet other embodiments of the disclosure, when heated at supercooling temperatures below 240° C., can resist isothermal crystallization for at least 0.6 s. Metallic glasses according to yet other embodiments of the disclosure, when heated at supercooling temperatures below 240° C., can resist isothermal crystallization for at least 0.8 s. Metallic glasses according to yet other embodiments of the disclosure, when heated at supercooling temperatures below 230° C., can resist isothermal crystallization for at least 0.7 s. Metallic glasses according to yet other embodiments of the disclosure, when heated at supercooling temperatures below 230° C., can resist isothermal crystallization for at least 0.9 s. Metallic glasses according to yet other embodiments of the disclosure, when heated at supercooling temperatures below 220° C., can resist isothermal crystallization for at least 0.8 s. Metallic glasses according to yet other embodiments of the disclosure, when heated at supercooling temperatures below 220° C., can resist isothermal crystallization for at least 1 s.

Figure 14:
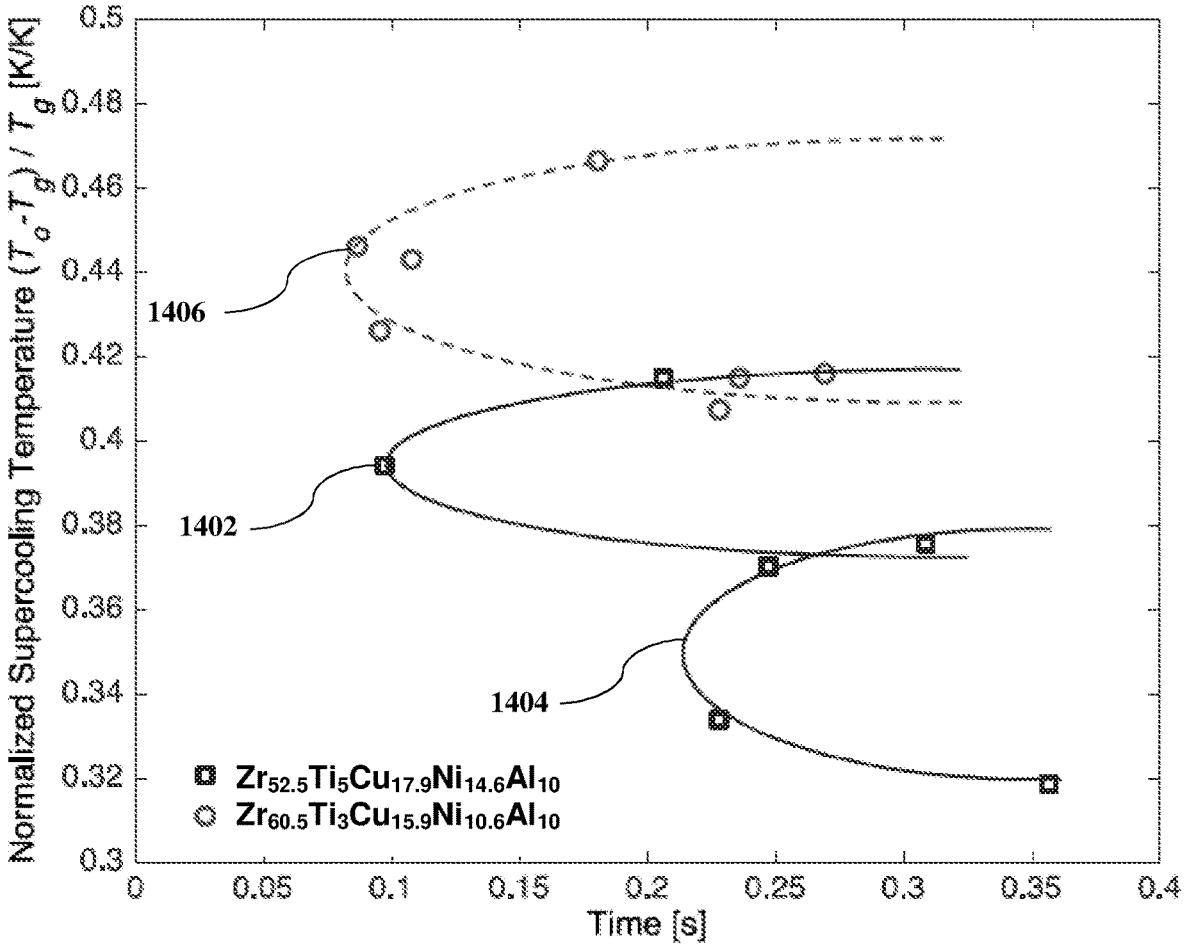
FIG. 14 provides TTT diagrams for metallic glasses $Zr_{52.5}Ti_5Cu_{17.9}Ni_{14.6}Al_{10}$ and $Zr_{60.5}Ti_3Cu_{15.9}Ni_{10.6}Al_{10}$ in accordance with embodiments of the disclosure.

In another embodiment, a temperature scale quantifying the supercooled liquid stability is represented by the normalized supercooling temperature, defined as the difference between the softening temperature $T_o$ and the glass transition temperature $T_g$, divided by the glass transition temperature $T_g$, i.e. $(T_o-T_g)/T_g$, expressed in units of K/K. The normalized supercooling temperatures for metallic glasses $Zr_{52.5}Ti_5Cu_{17.9}Ni_{14.6}Al_{10}$ (Example 7) and $Zr_{60.5}Ti_3Cu_{15.9}Ni_{10.6}Al_{10}$ (Example 19) are listed in Tables 10 and 11, respectively. Also the TTT diagrams where the temperature axis is represented by the normalized supercooling temperature for metallic glasses $Zr_{52.5}Ti_5Cu_{17.9}Ni_{14.6}Al_{10}$ (Example 7) and $Zr_{60.5}Ti_3Cu_{15.9}Ni_{10.6}Al_{10}$ (Example 19) are plotted in FIG. 14. As seen in Tables 10 and 11 and FIG. 14, the TTT diagram of metallic glass $Zr_{52.5}Ti_5Cu_{17.9}Ni_{14.6}Al_{10}$ (Example 7) includes two nose curves: a first curve 1402 at a higher temperature with a nose at a normalized supercooling temperature of about 0.4 and time of about 0.1 s, and a second curve 1404 at a lower temperature with a nose at a normalized supercooling temperature of about 0.34 and time of about 0.1 s. By contrast, the TTT diagram of metallic glass $Zr_{60.5}Ti_3Cu_{15.9}Ni_{10.6}Al_{10}$ (Example 19) includes only one nose curve 1406 at a relatively high temperature, with a nose at a normalized supercooling temperature of about 0.45 and time of about 0.08 s. The lack of a second, lower temperature TTT nose for $Zr_{60.5}Ti_3Cu_{15.9}Ni_{10.6}Al_{10}$ (Example 19) suggests that the supercooled liquid region of this metallic glass is very stable against crystallization, as metallic glass samples fail to crystallize at normalized supercooling temperatures below about 0.4 for a time of at least 1 s. On the other hand, at normalized supercooling temperatures below 0.4 and as low as 0.32, metallic glass $Zr_{52.5}Ti_5Cu_{17.9}Ni_{14.6}Al_{10}$ (Example 7) crystallizes in times as short as 0.38 s.

Therefore, metallic glasses according to some embodiments of the disclosure, when heated at normalized supercooling temperatures below 0.4, can resist isothermal crystallization for at least 0.5 s. Metallic glasses according to other embodiments of the disclosure, when heated at supercooling temperatures below 0.4, can resist isothermal crystallization for at least 0.7 s. Metallic glasses according to yet other embodiments of the disclosure, when heated at normalized supercooling temperatures below 0.38, can resist isothermal crystallization for at least 0.6 s. Metallic glasses according to yet other embodiments of the disclosure, when heated at normalized supercooling temperatures below 0.38, can resist isothermal crystallization for at least 0.8 s. Metallic glasses according to yet other embodiments of the disclosure, when heated at normalized supercooling temperatures below 0.36, can resist isothermal crystallization for at least 0.7 s. Metallic glasses according to yet other embodiments of the disclosure, when heated at normalized supercooling temperatures below 0.36, can resist isothermal crystallization for at least 0.9 s. Metallic glasses according to yet other embodiments of the disclosure, when heated at normalized supercooling temperatures below 0.34, can resist isothermal crystallization for at least 0.8 s. Metallic glasses according to yet other embodiments of the disclosure, when heated at normalized supercooling temperatures below 0.34, can resist isothermal crystallization for at least 1 s.

Methods of Processing Alloy Ingots of Sample Metallic Glass-Forming Alloys

A particular method for producing alloy ingots for the sample metallic glass-forming alloys involves arc melting of the appropriate amounts of elemental constituents over a water-cooled copper hearth under a titanium-gettered argon atmosphere. The purity levels of the constituent elements were as follows: Zr 99.9% (crystal bar), Ti 99.9% (crystal bar), Cu 99.995%, Ni 99.995%, and Al 99.999%. The argon atmosphere was created by first establishing vacuum at $1.5\times10^{-4}$ mbar, followed by a purge of ultra-high purity argon gas (99.999% purity) to establish a pressure of 800 mbar.

Methods of Processing Sample Metallic Glass Plates

A particular method for producing metallic glass plates from the metallic glass-forming alloy ingots for the sample metallic glass-forming alloys involves melting the alloy ingots over a water-cooled copper hearth under a titanium-gettered argon atmosphere to form an alloy melt, heating the alloy melt to a temperature of at least 1200° C., and subsequently pouring the alloy melt into a copper mold. Copper molds having a prismatic cavity with length of 55 mm, width of 22 mm, and varying thickness were used. The argon atmosphere was created by first establishing vacuum at $1.5\times10^{-4}$ mbar, followed by a purge of ultra-high purity argon gas (99.999% purity) to establish a pressure of 800 mbar.

Test Methodology for Differential Scanning Calorimetry

Differential scanning calorimetry was performed on sample metallic glasses at a scan rate of 20 K/min to determine the glass-transition, crystallization, solidus, and liquidus temperatures of sample metallic glasses.

Method of Producing Metallic Glass Rods for Evaluating Isothermal Crystallization Kinetics Metallic glass rods having 7 mm in diameter and about 100 mm in length were produced from the alloy ingots by the method of counter-gravity casting, where molten liquid contained in fused silica crucible is injected upwards (against gravity) into a mold using gas pressure. An inert atmosphere was created in a melt chamber by first applying vacuum at $5\times10^{-2}$ mbar and subsequently following several purges with argon, an argon atmosphere was established having a pressure of −3 to −5 in-Hg. The ingot was heated inductively first to 1200° C. to create a homogeneous high temperature melt and then allowed to cool back to 1100° C., and were subsequently urged upwards using an argon pressure of 2-3 psi through a fused silica straw of 7 mm inner diameter into a tool steel (H-13) mold having a rod-shaped cavity 7 mm in diameter and 100 mm in length. The melt was rapidly cooled in the mold to produce a quenched metallic glass rod having 7 mm in diameter and 100 mm in length. Multiple metallic glass rods were produced this way. The rods were sectioned to form shorter rods of 35-40 mm in length. The amorphicity of each rod was verified by x-ray diffraction. The rods were machined on a lathe to reduce their diameters from 7 mm to 5 mm, in order to eliminate any entrained pores near the surface that would cause localized heating and prematurely catalyze crystallization.

Method of Measuring the Sample Heating Response in Evaluating Crystallization Kinetics Metallic glass rods having 5 mm in diameter and length ranging between 35 and 40 mm produced as described above were clamped on each end between two copper collets with exposed length of approximately 35 mm. The copper plates were clamped in a vise and attached to leads of a capacitive discharge circuit. The capacitive discharge circuit has been disclosed in conjunction with a rapid capacitive discharging forming (RCDF) apparatus, such as in the following patents or patent applications: U.S. Pat. No. 8,613,813, entitled "Forming of metallic glass by rapid capacitor discharge;" U.S. Pat. No. 8,613,814, entitled "Forming of metallic glass by rapid capacitor discharge forging"; U.S. Pat. No. 8,613,815, entitled "Sheet forming of metallic glass by rapid capacitor discharge;" U.S. Pat. No. 8,613,816, entitled "Forming of ferromagnetic metallic glass by rapid capacitor discharge;" U.S. Pat. No. 9,297,058, entitled "Injection molding of metallic glass by rapid capacitor discharge;" and U.S. patent application Ser. No. 15/406,436, entitled "Feedback-assisted rapid discharge heating and forming of metallic glasses," each of which is incorporated by reference in its entirety.

A high-speed infrared pyrometer with a response time of 6 μs and an Indium-Gallium-Arsenide sensor with a spectral range of 1.58-2.2 μm were used to measure the temperature at the midpoint of each rod. A high speed infrared imaging camera (FLIR Corp., SC2500) with a spectral band from 0.9 to 1.7 mm outfitted with a bandpass filter allowing wavelengths from 1.5 to 1.9 mm was employed to record the evolution of the temperature distribution during heating, and to ensure that crystallization was initiated homogeneously from the midpoint of the rod. A Rogowski coil current sensor and voltage probe were used to measure the current and voltage, respectively, of the capacitive discharge pulse. Data from these sources were collected with an oscilloscope. Current and voltage data were used to verify that there were no anomalies in the shape of the current pulse.

Having described several embodiments, it will be recognized by those skilled in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

What is claimed is:

1. A metallic glass-forming alloy having a composition represented by the following formula (subscripts denote atomic percentages):

$$Zr_{(100-a-b-c-d)}Ti_aCu_bNi_cAl_d \quad \text{EQ. (1)}$$

where:

a ranges from 0.5 to 3.5;

b ranges from 12 to 18;

c ranges from 9 to 18; and d ranges from 7 to 13, wherein the metallic glass-forming alloy has a critical plate thickness of at least 4 mm, and wherein the thermal stability of the supercooled liquid of the metallic glass against crystallization $\Delta T_x = T_x - T_g$ is at least 78° C.

2. The alloy of claim 1, wherein a ranges from 0.5 to 3.5, b ranges from 13 to 18, c ranges from 10 to 17.5, and d ranges from 8 to 12.

3. The alloy of claim 1, wherein the ratio b/c ranges from 0.65 to 2.

4. The alloy of claim 1, wherein the critical plate thickness is at least 5 mm.

5. The alloy of claim 1, wherein the thermal stability of the supercooled liquid of the metallic glass against crystallization is at least 80° C.

6. The alloy of claim 1, wherein the time for isothermal crystallization when the metallic glass is heated at a supercooling temperature of less than 250° C. is at least 0.7 s.

7. The alloy of claim 1, wherein the time for isothermal crystallization when the metallic glass is heated at a normalized supercooling temperature of less than 0.4 is at least 0.7 s.

8. The alloy of claim 1, wherein the liquidus temperature of the alloy is below 850° C.

9. The alloy of claim 1, wherein the metallic glass-forming alloy comprises at least one of Nb, Ag, Pd, Co, Fe, Sn, and Be in a combined atomic concentration of up to 2%.

10. The alloy of claim 1, wherein the alloy is selected from $Zr_{56.5}Ti_1Cu_{17.9}Ni_{14.6}Al_{10}$, $Zr_{55.5}Ti_2Cu_{17.9}Ni_{14.6}Al_{10}$, $Zr_{55}Ti_{2.5}Cu_{17.9}Ni_{14.6}Al_{10}$, $Zr_{54.5}Ti_3Cu_{17.9}Ni_{14.6}Al_{10}$, $Zr_{54}Ti_{3.5}Cu_{17.9}Ni_{14.6}Al_{10}$, $Zr_{55.5}Ti_3Cu_{17.9}Ni_{14.6}Al_9$, $Zr_{53.5}Ti_3Cu_{17.9}Ni_{14.6}Al_{11}$, $Zr_{56.5}Ti_3Cu_{17.9}Ni_{12.6}Al_{10}$, $Zr_{56.5}Ti_3Cu_{17.9}Ni_{16.6}Al_{10}$, $Zr_{58.5}Ti_3Cu_{13.9}Ni_{14.6}Al_{10}$, $Zr_{57.5}Ti_3Cu_{14.9}Ni_{14.6}Al_{10}$, $Zr_{56.5}Ti_3Cu_{15.9}Ni_{14.6}Al_{10}$, and $Zr_{55.5}Ti_3Cu_{16.9}Ni_{14.6}Al_{10}$.

11. A metallic glass formed of the alloy of claim 1.

12. A method of thermoplastically shaping the metallic glass of claim 11 into an article, the method comprising:

heating a sample of the metallic glass to a softening temperature $T_o$ above the glass transition temperature $T_g$ of the metallic glass to form a heated sample;

applying a deformational force to shape the heated sample over a time that is shorter than a crystallization onset time $t_o$ of the metallic glass, and cooling the heated sample of metallic glass-forming alloy to a temperature below $T_g$ to form the article.

13. The method of claim 11, wherein the step of heating a sample is selected from inductive heating and ohmic heating.

14. The method of claim 12, wherein the ohmic heating comprises the discharge of at least one capacitor.

15. The method of claim 11, wherein $T_o$ is higher than $T_x$ of the metallic glass and lower than the solidus temperatures of the metallic glass-forming alloy.

16. The method of claim 11, wherein $T_o$ is in the range of 500 to 800° C.

17. The method of claim 11, wherein $T_o$ is such that the supercooling temperature is in the range of 190 to 260° C.

18. The method of claim 12, wherein the step of melting an ingot comprises heating using a plasma arc or an inductive coil.

19. A metallic glass-forming alloy having a composition represented by the following formula (subscripts denote atomic percentages):

$$Zr_{(100-a-b-c-d)}Ti_aCu_bNi_cAl_d \quad \text{EQ. (1)}$$

where:

a ranges from 0.5 to 3.5;

b ranges from 12 to 18;

c ranges from 9 to 18; and d ranges from 7 to 13, wherein the metallic glass-forming alloy has a critical plate thickness of at least 4 mm, and wherein the time for isothermal crystallization when the metallic glass is heated at a supercooling temperature of less than 250° C. is at least 0.5 s.

20. A metallic glass-forming alloy having a composition represented by the following formula (subscripts denote atomic percentages):

$$Zr_{(100-a-b-c-d)}Ti_aCu_bNi_cAl_d \quad \text{EQ. (1)}$$

where:

a ranges from 0.5 to 3.5;

b ranges from 12 to 18;

c ranges from 9 to 18; and d ranges from 7 to 13, wherein the alloy is capable of forming a metallic glass and has a critical plate thickness of at least 4 mm, and wherein the time for isothermal crystallization when the metallic glass is heated at a normalized supercooling temperature of less than 0.4 is at least 0.5 s.

21. The alloy of claim 1, wherein b ranges from 12 to 17, wherein the metallic glass-forming alloy has a critical plate thickness of at least 5 mm.

22. The alloy of claim 19, wherein b ranges from 12 to 17, wherein the metallic glass-forming alloy has a critical plate thickness of at least 5 mm.

23. The alloy of claim 20, wherein b ranges from 12 to 17, wherein the alloy is capable of forming a metallic glass and has a critical plate thickness of at least 5 mm.

* * * * *